US009176425B2

(12) United States Patent
Takami et al.

(10) Patent No.: US 9,176,425 B2
(45) Date of Patent: Nov. 3, 2015

(54) DEVELOPER REPLENISHING DEVICE TO TRANSPORT DEVELOPER FROM DEVELOPER CONTAINER, IMAGE FORMING APPARATUS INCLUDING SAME, AND CONVEYANCE DEVICE TO TRANSPORT POWDER OR FLUID FROM CONTAINER

(71) Applicants: Nobuo Takami, Kanagawa (JP); Junichi Matsumoto, Kanagawa (JP); Kiyonori Tsuda, Kanagawa (JP); Yutaka Takahashi, Kanagawa (JP); Kentaro Mikuniya, Tokyo (JP)

(72) Inventors: Nobuo Takami, Kanagawa (JP); Junichi Matsumoto, Kanagawa (JP); Kiyonori Tsuda, Kanagawa (JP); Yutaka Takahashi, Kanagawa (JP); Kentaro Mikuniya, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/173,104

(22) Filed: Feb. 5, 2014

(65) Prior Publication Data

US 2014/0248061 A1 Sep. 4, 2014

(30) Foreign Application Priority Data

Mar. 1, 2013 (JP) ..... 2013-040873

(51) Int. Cl.
*G03G 15/00* (2006.01)
*G03G 15/08* (2006.01)

(52) U.S. Cl.
CPC ..... *G03G 15/0887* (2013.01); *G03G 15/0872* (2013.01)

(58) Field of Classification Search
CPC ..... G03G 15/0872; G03G 15/0887
See application file for complete search history.

(56) References Cited

U.S. PATENT DOCUMENTS

| | | | | | |
|---|---|---|---|---|---|
| 4,086,006 | A | * | 4/1978 | Hauser et al. | 399/257 |
| 4,640,605 | A | * | 2/1987 | Ariyama et al. | 399/225 |
| 4,796,051 | A | * | 1/1989 | Monkelbaan et al. | 399/233 |
| 4,923,581 | A | * | 5/1990 | Day | 204/571 |
| 4,987,429 | A | * | 1/1991 | Finley et al. | 347/115 |
| 5,231,455 | A | * | 7/1993 | Day | 399/225 |
| 5,268,721 | A | * | 12/1993 | Day | 399/164 |
| 5,319,421 | A | * | 6/1994 | West | 399/59 |
| 5,404,210 | A | * | 4/1995 | Day | 399/225 |
| 5,442,427 | A | * | 8/1995 | Day | 399/237 |
| 5,797,074 | A | * | 8/1998 | Kasahara et al. | 399/262 |

(Continued)

FOREIGN PATENT DOCUMENTS

| | | |
|---|---|---|
| JP | 2003-295726 | 10/2003 |
| JP | 2004-004559 | 1/2004 |
| JP | 2007-114667 | 5/2007 |

*Primary Examiner* — David Bolduc
(74) *Attorney, Agent, or Firm* — Oblon, McClelland, Maier & Neustadt, L.L.P.

(57) ABSTRACT

A developer replenishing device includes a container mount to hold a developer container to contain developer used in image formation, an installation completion detector to detect completion of installation of the developer container in the container mount, a replaceable containing portion to contain developer, a conveyance channel to which the containing portion is removably connected and through which developer is transported from the developer container held in the container mount to the containing portion, and a conveyance pump to transport developer from the developer container through the conveyance channel to the containing portion. In a state in which the developer container is not held in the container mount according to a detection result by the installation completion detector, the conveyance pump transports developer from the conveyance channel to the containing portion.

15 Claims, 15 Drawing Sheets

(56) References Cited

U.S. PATENT DOCUMENTS

| | | | | |
|---|---|---|---|---|
| 6,151,471 | A * | 11/2000 | Yahata et al. | 399/258 |
| 6,233,410 | B1 * | 5/2001 | Seber et al. | 399/24 |
| 6,283,573 | B1 * | 9/2001 | Nakamura | 347/23 |
| 7,003,233 | B2 * | 2/2006 | Matsuda et al. | 399/27 |
| 7,369,783 | B2 * | 5/2008 | Kikuchi | 399/12 |
| 7,372,479 | B2 * | 5/2008 | Ohkubo | 347/261 |
| 7,453,589 | B2 * | 11/2008 | Nakagawa | 358/1.14 |
| 7,464,922 | B2 * | 12/2008 | Kozaki et al. | 271/9.11 |
| 2003/0215267 | A1 * | 11/2003 | Kita | 399/258 |
| 2003/0215268 | A1 * | 11/2003 | Kita | 399/258 |
| 2003/0235435 | A1 * | 12/2003 | Muramatsu et al. | 399/258 |
| 2004/0009015 | A1 * | 1/2004 | Fujimori et al. | 399/258 |
| 2004/0131390 | A1 * | 7/2004 | Kita | 399/258 |
| 2004/0170441 | A1 * | 9/2004 | Forbes et al. | 399/27 |
| 2004/0170442 | A1 * | 9/2004 | Forbes et al. | 399/27 |
| 2004/0190944 | A1 * | 9/2004 | Kita | 399/258 |
| 2004/0213593 | A1 * | 10/2004 | Brewington et al. | 399/27 |
| 2005/0002699 | A1 * | 1/2005 | Tamura et al. | 399/258 |
| 2005/0129422 | A1 * | 6/2005 | Lee | 399/57 |
| 2005/0244172 | A1 * | 11/2005 | Kreckel | 399/27 |
| 2005/0286917 | A1 * | 12/2005 | Martin et al. | 399/27 |
| 2006/0165422 | A1 * | 7/2006 | Kikuchi et al. | 399/13 |
| 2006/0222382 | A1 * | 10/2006 | Gady et al. | 399/27 |
| 2007/0122204 | A1 * | 5/2007 | Kita | 399/258 |
| 2007/0177886 | A1 * | 8/2007 | Taguchi et al. | 399/12 |
| 2008/0044190 | A1 * | 2/2008 | Silence | 399/27 |
| 2008/0080876 | A1 * | 4/2008 | Facci et al. | 399/27 |
| 2008/0193161 | A1 * | 8/2008 | Sano et al. | 399/119 |
| 2008/0253810 | A1 * | 10/2008 | Tateyama et al. | 399/258 |
| 2008/0273047 | A1 * | 11/2008 | Kawarazuka et al. | 347/6 |
| 2009/0041520 | A1 | 2/2009 | Takeuchi et al. | |
| 2010/0046972 | A1 * | 2/2010 | Jugle et al. | 399/54 |
| 2010/0092188 | A1 * | 4/2010 | Hirayama et al. | 399/27 |
| 2010/0129118 | A1 | 5/2010 | Kimura et al. | |
| 2010/0329702 | A1 * | 12/2010 | Dirubio et al. | 399/27 |
| 2011/0058857 | A1 * | 3/2011 | Hori et al. | 399/262 |
| 2011/0110689 | A1 * | 5/2011 | Hirayama et al. | 399/258 |
| 2011/0243579 | A1 | 10/2011 | Oshikawa et al. | |
| 2011/0249991 | A1 | 10/2011 | Hosokawa et al. | |
| 2011/0318023 | A1 * | 12/2011 | Thayer et al. | 399/27 |
| 2012/0033998 | A1 | 2/2012 | Hori et al. | |
| 2012/0163877 | A1 | 6/2012 | Kikuchi et al. | |
| 2012/0195645 | A1 | 8/2012 | Takami et al. | |
| 2012/0219330 | A1 | 8/2012 | Kikuchi et al. | |
| 2012/0230733 | A1 | 9/2012 | Kikuchi et al. | |
| 2012/0230738 | A1 | 9/2012 | Yoshizawa et al. | |
| 2012/0269544 | A1 | 10/2012 | Tsuda et al. | |
| 2012/0269553 | A1 | 10/2012 | Yoshizawa et al. | |
| 2012/0308242 | A1 * | 12/2012 | Yamane et al. | 399/13 |
| 2012/0321341 | A1 | 12/2012 | Hori et al. | |
| 2013/0266345 | A1 | 10/2013 | Matsumoto et al. | |

* cited by examiner

DEVELOPER REPLENISHING DEVICE TO TRANSPORT DEVELOPER FROM DEVELOPER CONTAINER, IMAGE FORMING APPARATUS INCLUDING SAME, AND CONVEYANCE DEVICE TO TRANSPORT POWDER OR FLUID FROM CONTAINER

CROSS-REFERENCE TO RELATED APPLICATION

This patent application is based on and claims priority pursuant to 35 U.S.C. §119 to Japanese Patent Application No. 2013-040873, filed on Mar. 1, 2013, in the Japan Patent Office, the entire disclosure of which is hereby incorporated by reference herein.

BACKGROUND OF THE INVENTION

1. Technical Field

The present invention generally relates to a developer replenishing device to transport developer from a developer container to an image forming apparatus, such as, a copier, a printer, a facsimile machine, or a multifunction machine including at least two of these functions; an image forming apparatus including the developer replenishing device; and a conveyance device to transport powder or fluid from the a container.

2. Description of the Background Art

There are image forming apparatuses that develop electrostatic latent images formed on a latent image bearer by a developing device using developer such as toner, thereby forming images. In such image forming apparatuses, toner inside the developing device is consumed in image formation. Accordingly, there are image forming apparatuses that use a replaceable container containing developer or toner and a developer replenishing device to supply developer or toner from the replaceable container to the developing device. For example, JP-3741691-B (JP-2004-004559-A) proposes a configuration in which a toner replenishing device (i.e., developer replenishing device) is connected to a container via a conveying tube (i.e., conveyance channel) and a pump is used to transport toner from the container through the conveying tube to the developing device. Connecting the container via the conveying tube to the developing device is advantageous in enhancing flexibility in layout (relative positions) of these components.

SUMMARY OF THE INVENTION

In view of the foregoing, one embodiment of the present invention provides a developer replenishing device that includes a container mount to hold a developer container to contain developer used in image formation, an installation completion detector to detect completion of installation of the developer container in the container mount, a replaceable containing portion to contain developer supplied from the developer container, a conveyance channel through which developer is transported from the developer container held in the container mount to the containing portion, and a conveyance pump to transport developer from the developer container through the conveyance channel to the containing portion. The containing portion is removably connected to the conveyance channel. In a state in which the developer container is not held in the container mount according to the installation completion detector, the conveyance pump transports developer from the conveyance channel to the containing portion.

In another embodiment, an image forming apparatus includes an image bearer on which an image is formed with developer, and the above-described developer replenishing device.

Yet another embodiment provides a conveyance device that includes a container mount to hold a container to contain powder or fluid, an installation completion detector to detect completion of installation of the container in the container mount, a replaceable containing portion to contain the powder or fluid supplied from the developer container, a conveyance channel through which the powder or fluid is transported from the container held in the container mount to the containing portion, and a conveyance pump to transport the powder or fluid from the container through the conveyance channel to the containing portion. The containing portion is removably connected to the conveyance channel. In a state in which the container is not held in the container mount according to a detection result by the installation completion detector, the conveyance pump transports the powder or fluid from the conveyance channel to the containing portion.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
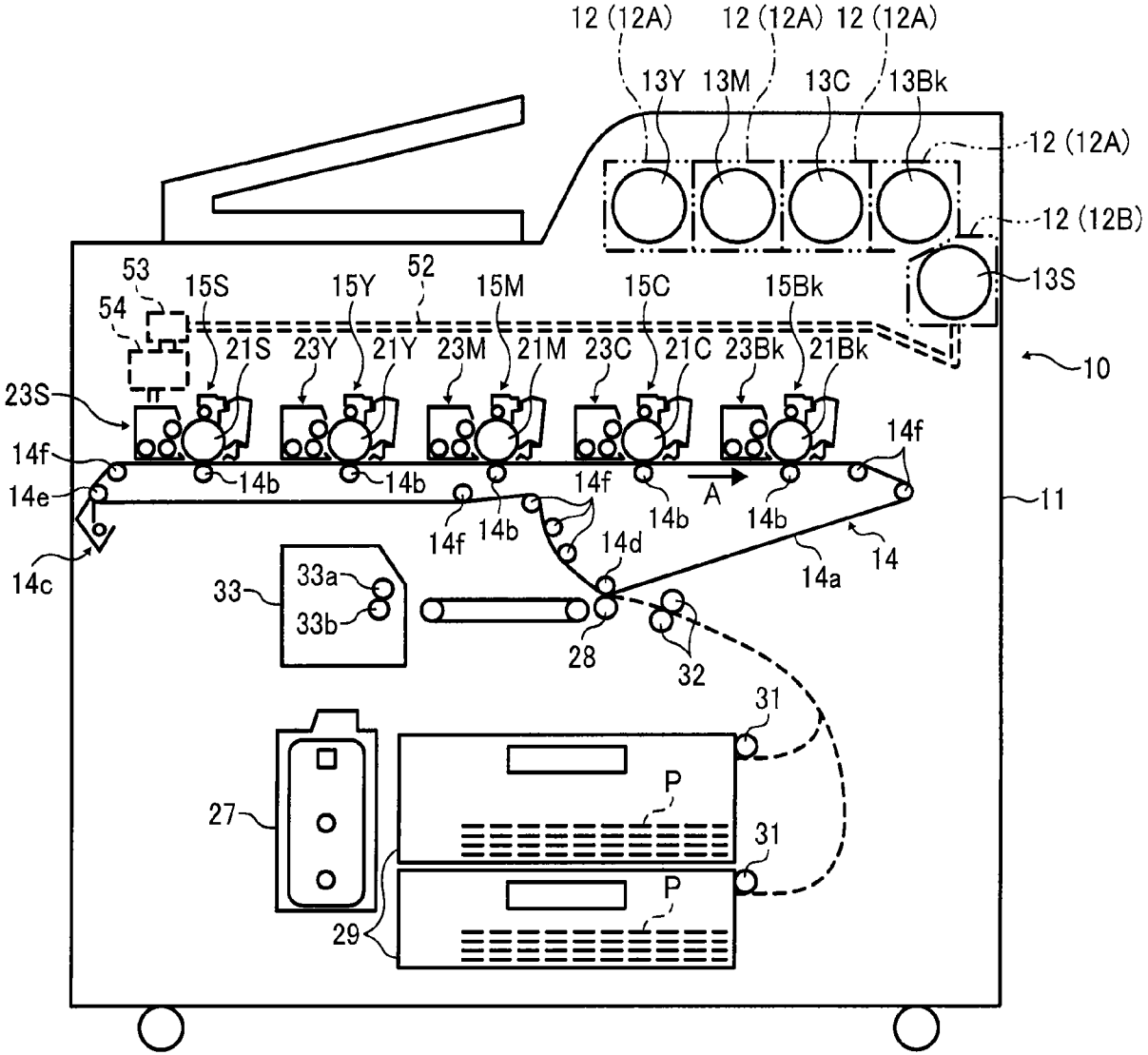
FIG. 1 is a schematic view illustrating a configuration of an image forming apparatus according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

It is to be understood that an identical or similar reference character is given to identical or corresponding parts throughout the drawings, and redundant descriptions are omitted or simplified below. Further, the suffixes S, Y, M, C, and Bk attached to each reference numeral indicate only that components indicated thereby are used for forming special toner, yellow toner, magenta toner, cyan toner, and black toner images, respectively, and hereinafter may be omitted when discrimination among them is not necessary.

In image forming apparatuses, in addition to four color toners typically used to form multicolor images on recording media, use of toner different in color or type from the four color toners is known. Herein after such toner is referred to as "special toner". Special toner can be a special color toner whose color is not easily reproduced by subtractive color mixing of the four color toners or transparent toner or clear toner to enhance the gloss level of color images.

Special toner type differs depending on the intended use, and there arises a need to change the special toner type. In such a configuration, although replacement of the container containing special toner is easy, it is possible that special toner used before the replacement (hereinafter "special toner before replacement or first toner") remains in the developing device and the toner replenishing device. If the special toner before replacement remains in the toner replenishing device, the quality of images formed on sheets can be degraded. In view of the foregoing, it is proposed to make the developing device and the toner replenishing device replaceable.

An aim of the embodiment described below is to provide a developer replenishing device capable of using different types of developer without degrading quality of images formed in recording media.

Referring now to the drawings, wherein like reference numerals designate identical or corresponding parts throughout the several views thereof, a toner replenishing device 50, serving as a developer replenishing device according to an embodiment of the present invention, and an image forming apparatus 10 serving as an embodiment of an image forming apparatus in which the toner replenishing device 50 is mounted are described. Initially, a configuration and operation of the image forming apparatus 10 is described below.

Figure 2:
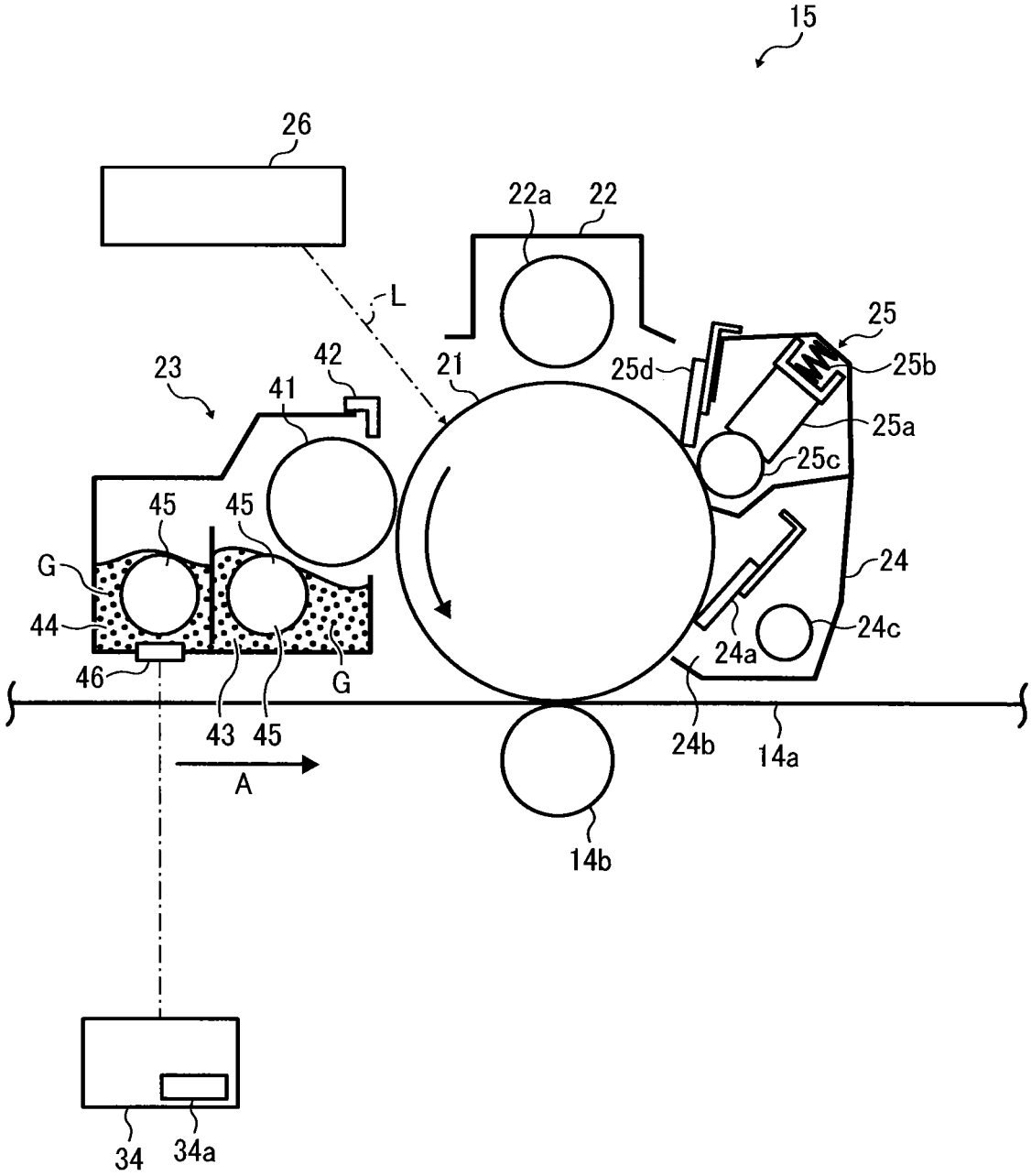
FIG. 2 is a schematic end-on axial view of an image forming unit including a developing device according to an embodiment.

FIG. 1 is a schematic view illustrating a configuration of the image forming apparatus 10 according to the present embodiment. FIG. 2 is a schematic end-on axial view of an image forming unit 15 including a developing device 23 according to the present embodiment.

The image forming apparatus 10 shown in FIG. 1 can be a multicolor printer, and components thereof are housed in a box-shaped housing 11. In an upper portion of the image forming apparatus 10 (or the housing 11), four container mounts 12A are provided. The four container mounts 12A are arranged parallel to each other corresponding to four toner containers 13Y, 13M, 13C, and 13Bk for containing yellow, magenta, cyan, and black toners, respectively. The toner containers 13 are replaceable and removably mounted in the respective container mounts 12A. Additionally, a container mount 12B is provided obliquely beneath the toner container 13Bk in FIG. 1, and a toner container 13S is replaceably (removably) mounted in that container mount 12B.

It is to be noted that the container mounts 12A and 12B are also referred to as "container mounts 12" collectively.

When a front cover of the housing 11 is opened, the toner containers 13S, 13Y, 13M, 13C, and 13Bk in the respective container mounts 12 can be exposed.

It is to be noted that the term "replaceable" and "replaceably" in this specification concern replacement work executed by users and mean that replacement work by users can be relatively easy. In FIG. 1, reference numerals 52 represents a toner conveying tube, 53 represents a conveyance pump, 54 represents a sub-hopper, and 55 represents a toner conveying pipe.

The respective color toners contained in the toner containers 13S, 13Y, 13M, 13C, and 13Bk in the respective container mounts 12 are supplied to the corresponding developing devices 23 according to the amount of toner consumed. The toner containers 13S, 13Y, 13M, 13C, and 13Bk are replaced when the service lives thereof expire, that is, almost all toner therein is consumed. Configurations therefor are described in further detail later.

In the image forming apparatus 10 (housing 11), an intermediate transfer unit 14 is provided. The intermediate transfer unit 14 includes an intermediate transfer belt 14*a*, five primary-transfer bias rollers 14*b*, an intermediate-transfer cleaning unit 14*c*, a secondary-transfer backup roller 14*d*, a cleaning backup roller 14*e*, and multiple support rollers 14*f*. In the intermediate transfer unit 14, the intermediate transfer belt 14*a* are looped and stretched around the secondary-transfer backup roller 14*d*, the cleaning backup roller 14*e*, and the support rollers 14*f*. The intermediate transfer belt 14*a* is an endless belt that rotates following an identical route regardless of the start end and the finish end as the secondary-transfer backup roller 14*d* rotates. Image forming units 15S, 15Y, 15M, 15C, and 15Bk corresponding special toner, yellow toner, magenta toner, cyan toner, and black toner, respectively are arranged in parallel to each other and disposed facing the intermediate transfer belt 14*a*.

Special toner is different in characteristics from the four color toners (yellow, magenta, cyan, and black toners) typically used to form multicolor images. The characteristics here include color (hue), lightness, transmittance, gloss level after fixing process, and magnetic properties. Special toner includes transparent toner (clear toner), special color toner, magnetic ink character recognition (MICR) toner.

Transparent toner is used to enhance the gloss level of color images and transferred as a top layer of the four color toners (yellow, magenta, cyan, and black toners) used to form multicolor images, thereby enhancing the smoothness of the color image. It is to be noted that there are multiple types of transparent toners to attain different gloss levels. Special color toner is used to reproduce colors that are not easily reproduced by subtractive color mixing of the four color toners typically used to form multicolor images and further used to form multicolor images on colored sheets (except white sheets). Special color toner includes white toner, gold toner, and silver toner. MICR toner is used in so-called magnetic printing to make images (including texts or character strings) readable by computers or the like.

The image forming unit 15S using special toner is disposed upstream from any of other image forming units 15Y, 15M, 15C, and 15Bk in the direction indicated by arrow A (hereinafter "direction A"), in which the intermediate transfer belt 14*a* rotates. The image forming unit 15S is on the left In FIG. 1, extreme upstream among the five image forming units 15 in the direction A, since transparent toner, one type of special toners, forms the top layer above the four color toners. Specifically, as described later, images respectively formed by the image forming unit 15S, 15Y, 15M, 15C, and 15Bk are transferred onto the intermediate transfer belt 14*a* (at primary transfer) sequentially in the direction A in which the intermediate transfer belt 14*a* rotates, and then the respective images together forming a multicolor image. Then, the multicolor image is secondarily transferred from the intermediate transfer belt 14*a* onto a sheet P. Accordingly, the bottom layer among the multiple toners superimposed on the intermediate transfer belt 14*a* becomes the top layer on the sheet P. Therefore, the image forming unit 15S is positioned extreme upstream in the direction A in which the intermediate transfer belt 14*a* rotates.

As described above, special toner type differs depending on the intended use, and there arises a need to change the special toner type. At that time, if simply the toner container 13S is replaced to change the special toner type from the original toner (i.e., first toner) to another toner (i.e., second toner), it is possible that the original toner remains in the toner replenishing device 50 shown in FIG. 3.

In image forming apparatuses, however, to keep the apparatus compact while facilitating replacement work of toner containers (i.e., developer containers), typically toner conveying tubes (serving as developer conveyance channels) of toner replenishing devices (developer replenishing devices), through which developer (i.e., toner) is transported, pass clearances between various components inside the apparatus according to relative positions of the toner container and the developing device.

Thus, it is not easy to make toner conveying tubes replaceable in image forming apparatuses. In particular, since toner remains inside the toner conveying tube when the toner conveying tube is replaced, there is a risk that toner leaks therefrom. Thus, it is not easy to make the toner conveying tubes replaceable while preventing leak of toner therefrom at the time of replacement.

For example, when white toner is replaced with transparent toner, which is transferred over the entire image as the top layer, white dots are present in the entire image if remaining white toner is mixed in transparent toner. Thus, if the first toner used before replacement remains in the toner replenishing device 50 (the toner conveying tube 52 in particular), the quality of images formed on the sheets P are degraded.

In view of the foregoing, the toner replenishing device 50 according to the present embodiment is designed to prevent the first toner used before replacement from remaining therein (in particular, in the toner conveying tube 52) when the toner container 13S is replaced with another toner container 13S containing the second toner different from the first toner, which is described in further detail later.

It is to be noted that, in the image forming apparatus 10, although the numbers of the toner containers 13, the image forming units 15, and the like are five corresponding the five toners (special toner and yellow, magenta, cyan, and black toners), such components have a similar configuration. Therefore, the suffixes S, Y, M, C, and Bk attached to each reference numeral indicating special toner, yellow, magenta, cyan, and black, respectively, are omitted in the descriptions below and FIG. 2.

As shown in FIG. 2, the image forming unit 15 includes a photoreceptor drum 21 and a charging device 22, the developing device 23, a cleaning unit 24, and an lubrication unit 25 disposed around the photoreceptor drum 21. Image forming processes, namely, charging, exposure, development, transfer, and cleaning processes are performed on the photoreceptor drum 21, and thus a toner image of corresponding color is formed on the photoreceptor drum 21.

Referring to FIG. 2, the photoreceptor drum 21 is rotated counterclockwise in FIG. 2 by a driving motor. The surface of the photoreceptor drum 21 is charged by the charging device 22 uniformly at the position facing the charging device 22 (charging process). The charging device 22 includes a charging roller 22*a* that rotates while receiving a charging bias from a power source. The charging device 22 further includes a charging roller cleaner to clean the surface of the charging roller 22*a*.

Then, the photoreceptor drum 21 reaches a portion to receive a laser beam (exposure light) L emitted from an exposure unit 26 and is scanned with the laser beam L. Thus, an electrostatic latent image of the corresponding color is formed thereon (exposure process). Specifically, the surface of the photoreceptor drum 21 is discharged (electrical potentials is changed) with the exposure light L selectively according to image data, thus forming an electrostatic latent image by differences (potential contrast) in electrical potential between the discharged portion and portions that are not discharged. In the exposure process, receiving the light, an electric charge generating substance in a photosensitive layer of the photoreceptor drum 21 generates electrical charges, and holes among them counteract with the charge potential on the photoreceptor drum 21.

Then, the photoreceptor drum 21 reaches a position facing the developing device 23, where the latent image is developed with toner into a toner image (development process). The operation of the developing device 23 is described in further detail later. When the surface of the photoreceptor drum 21 carrying the toner image reaches a position facing the primary-transfer bias roller 14*b* via the intermediate transfer belt 14*a*, the toner image is transferred therefrom onto the intermediate transfer belt 14*a* (primary-transfer process). After the primary-transfer process, a certain amount of toner tends to remain on the photoreceptor drum 21.

When the surface of the photoreceptor drum 21 reaches a position facing the cleaning unit 24, a cleaning blade 24*a* of the cleaning unit 24 mechanically collects toner remaining on the photoreceptor drum 21 (cleaning process). The cleaning unit 24 includes a collecting section 24*b* to which toner (i.e., waste toner) removed by the cleaning blade 24*a* is collected. The collecting section 24*b* is provided with a conveying screw 24*c* (e.g., an auger screw) to transport the waste toner to a waste toner bottle 27 (shown in FIG. 1). The waste toner bottle 27 stores the waste toner collected by the cleaning unit 24 for disposal and removably mounted in the image forming apparatus 10 (i.e., housing 11). Subsequently, the surface of the photoreceptor drum 21 reaches the position facing the discharger, and potentials remaining thereon are removed at that position.

The surface of the photoreceptor drum 21 further reaches the position facing the lubrication unit 25 and is lubricated at that position. Lubricant is used to reduce the friction coefficient of the photoreceptor drum 21. In the lubrication unit 25, a solid lubricant 25*a* is pressed by a pressure spring 25*b* against an applicator 25*c*. The applicator 25*c* is constructed of, for example, a rotatable fur brush and designed to apply lubricant, being pressed against the surface of the photoreceptor drum 21. For example, a typical lubricant is zinc stearate (ZnSt). Additionally, insulating polyethylene terephthalate (PET), conductive PET, acrylic resin fiber, and the like can be used as the fur brush serving as the applicator 25*c*. The lubricant applied to the surface of the photoreceptor drum 21 is leveled by an application blade 25*d* and stays thereon. Lubricating the surface of the photoreceptor drum 21 is effective in inhibiting toner filming on the photoreceptor drum 21. Thus, a sequence of image forming processes performed on the photoreceptor drum 21 is completed.

The above-described image forming processes are performed in the image forming units 15S, 15Y, 15M, 15C, and 15Bk similarly. For the image forming process in each image forming unit 15, the exposure unit 26 (shown in FIG. 2) directs the laser beams L thereto. Specifically, the exposure unit 26 includes one or multiple light sources to emit the laser beams L, which are directed to the respective photoreceptor drums 21 via multiple optical elements while deflecting the laser beams L with a polygon mirror. Then, the image forming unit 15S forms a special toner image. The image forming unit 15Y, 15M, 15C, and 15Bk form yellow, magenta, cyan, and black toner images, respectively.

In the intermediate transfer unit 14, the five primary-transfer bias rollers 14*b* are pressed against the corresponding photoreceptor drums 21 via the intermediate transfer belt 14*a*, and five contact portions between the primary-transfer bias rollers 14*b* and the corresponding photoreceptor drums 21 are hereinafter referred to as primary-transfer nips. Each primary-transfer bias roller 14*b* receives a transfer bias whose polarity is opposite the charge polarity of toner. With this configuration, while the intermediate transfer belt 14*a* rotates in the direction A shown in FIG. 2, passing through the respective primary-transfer nips between the primary-transfer bias rollers 14*b* and the photoreceptor drums 21, the toner images are primarily transferred from the respective photoreceptor drums 21 and superimposed one on another on the intermediate transfer belt 14*a*. Thus, a multicolor toner image together with the special toner is formed on the intermediate transfer belt 14*a*.

Then, the intermediate transfer belt 14*a* carrying the superimposed toner image reaches a portion facing the secondary-transfer roller 28. The secondary-transfer roller 28 and the secondary-transfer backup roller 14*d* press against each other via the intermediate transfer belt 14*a*, thus forming a secondary-transfer nip. The toner image formed with the four color toners and the special toner (hereinafter "multicolor toner image") is transferred from the intermediate transfer belt 14*a* onto the sheet P (recording medium) transported to the secondary-transfer nip (secondary-transfer process). At that time, a certain amount of toner tends to remain on the intermediate transfer belt 14*a*.

When the intermediate transfer belt 14*a* reaches a position facing the intermediate-transfer cleaning unit 14*c*, toner remaining on the intermediate transfer belt 14*a* is collected by the intermediate-transfer cleaning unit 14*c*. Similarly to the cleaning unit 24 (shown in FIG. 2) provided to the image forming unit 15, waste toner collected by the intermediate-transfer cleaning unit 14*c* is transported to the waste toner bottle 27. Thus, a sequence of image forming processes performed on the intermediate transfer belt 14*a* is completed.

The sheet P is transported by one of sheet feeders 29 (or sheet trays) provided in a lower portion of the image forming apparatus 10 to the secondary-transfer nip via a feed roller 31, a pair of registration rollers 32, and the like. In the sheet feeder 29, sheets P of, for example, transfer paper, recording paper, or overhead projector (OHP) film, are piled one on another. The feed roller 31 rotates counterclockwise in FIG. 1 to feed the sheet P on the top toward a nip formed between the registration rollers 32. When the leading edge of the sheet P reaches the nip therebetween, the registration rollers 32 suspend rotation, stopping the sheet P. The registration rollers 32 resume rotation to transport the sheet P to the secondary-transfer nip, time to coincide with the arrival of the multicolor toner image formed on the moving intermediate transfer belt 14*a*. Thus, the multicolor toner image becomes a full color image on the white sheet P.

Subsequently, the sheet P carrying the multicolor image is transported to a fixing device 33. In the fixing device 33, the multicolor toner image is fixed on the sheet P with heat and pressure exerted by a heating roller 33*b* and a pressure roller 33*a*. Subsequently, the sheets P are sequentially discharged by a pair of discharge rollers outside the apparatus (housing 11) and stacked as output images. Thus, a sequence of image forming processes performed in the image forming apparatus 10 is completed.

Next, a configuration and operation of the developing device 23 in the image forming unit 15 is described with reference to FIGS. 2 and 3.

Figure 3:
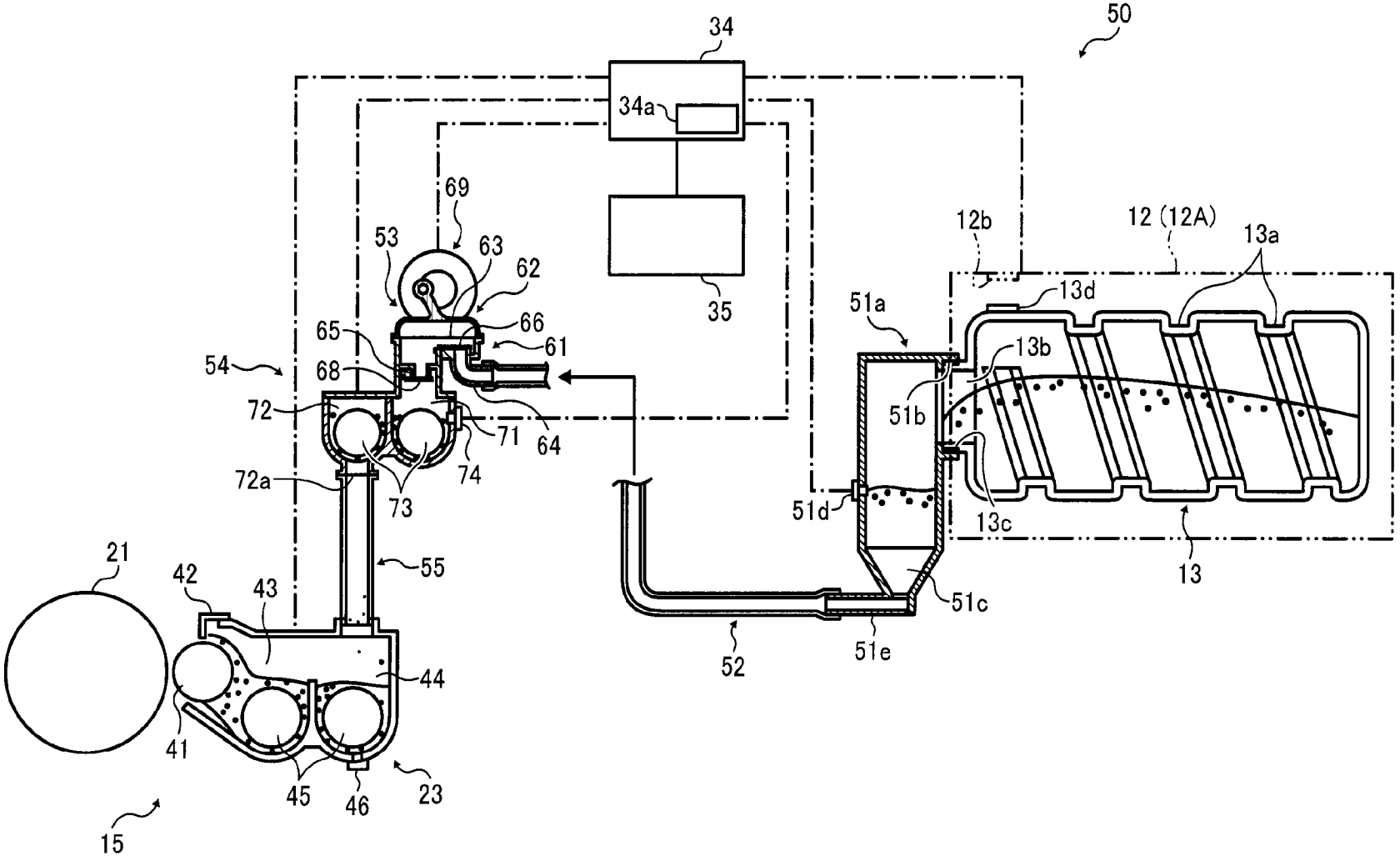
FIG. 3 is a schematic view of a toner replenishing device and a toner replenishing channel.

FIG. 3 is a schematic view of the toner replenishing device 50 and a toner replenishing channel thereof. It is to be noted that a reference character "G" in FIG. 2 represents developer.

The developing device 23 includes a developing roller 41 disposed facing the photoreceptor drum 21, a doctor blade 42 disposed facing the developing roller 41, developer containing compartments 43 and 44, two conveying screws 45 respectively disposed in the developer containing compartments 43 and 44, and a density sensor 46 to detect the concentration of toner in developer. A casing of the developing device 23 is divided, at least partially, into the developer containing compartments 43 and 44. The developing roller 41 includes a stationary magnet provided thereinside and a sleeve that rotates around the magnet. The developer containing compartments 43 and 44 contain two-component developer consisting essentially of carrier (carrier particles) and toner (toner particles). That is, the image forming apparatus 10 according to the present embodiment forms images using two-component developer.

The developing device 23, together with the toner conveying pipe 55, can be removed from the apparatus body of the image forming apparatus 10. In other words, the developing roller 41, the doctor blade 42, the developer containing compartments 43 and 44, the two conveying screws 45, and the density sensor 46 are combined into the developing device 23 that is an integrated unit. The developing device 23 can be removed from the image forming apparatus 10 (i.e., housing 11) while keeping the combination of these components (see FIG. 12). Thus, replacement of the developing device 23 is easy.

Carrier (carrier particles) in developer stands on end on the sleeve of the developing roller 41, forming chains, along the magnetic force lines in a normal direction, exerted from the magnets. Toner (toner particles) adheres to the carrier standing on end into chains, thus forming a magnetic brush. As the sleeve rotates, the magnetic brush is transported in the same direction as the rotation direction of the sleeve.

An opening is formed in an upper portion of the developer containing compartment 44, and the developer containing compartment 44 is connected via the opening to the toner conveying pipe 55 (shown in FIG. 3). The toner conveying pipe 55 is a part of the toner replenishing device 50 (shown in FIG. 3). Toner is supplied through the toner conveying pipe 55 to the developing device 23 to keep the ratio of toner to carrier (concentration of toner) in developer contained in the developing device 23 within a predetermined range. The toner replenishing device 50 supplies toner from the toner container 13 to the developer containing compartment 44 according to the consumption of toner in the developing device 23. The configuration and operation of the toner replenishing device 50 and the toner container 13 are described in further detail later.

The density sensor 46 detects the density of toner or the concentration of toner in developer. The density sensor 46 detects the magnetic permeability of developer, thereby detecting the concentration of toner in developer. The magnetic permeability of developer has a good correlation with the concentration of toner in developer. The density sensor 46 is connected to a controller 34 and outputs electric signals indicating the detected magnetic permeability to the controller 34. A control panel 35 is connected to the controller 34.

The controller 34 includes a memory device 34*a* and a micro computer. The controller 34 is provided to the image forming apparatus 10 (i.e., housing 11) and have centralized control over the respective components according to programs stored in the memory device 34*a*. The memory device 34*a* stores target value Vtref that is a target of electric signals transmitted from the density sensor 46. The controller 34 compares the electric signal (output voltage) from the density sensor 46 with the stored target voltage Vtref and drives the toner replenishing device 50 (in particular, the conveyance pump 53 and conveying screws 73 shown in FIG. 3) for a time period corresponding to the comparison result. Accordingly, the developer replenishing device 50 supplies toner from the developer container 13 to the developer containing compartment 44 through the toner conveying pipe 55 according to the consumption of toner in the developing device 23. Thus, the concentration of toner in developer contained in the developer containing compartment 44 can be kept in a predetermined or desirable range. Thus, the developing device 23 serves as a replenishment target replenished by the toner replenishing device 50 as well as a part of a containing portion (i.e., developer chamber) for containing developer transported by the toner replenishing device 50. Accordingly, the density sensor 46 provided to the developer containing compartment 44 serves as a detector to detect the amount of developer (or toner) serving as powder or fluid contained in the containing portion.

Figure 9:
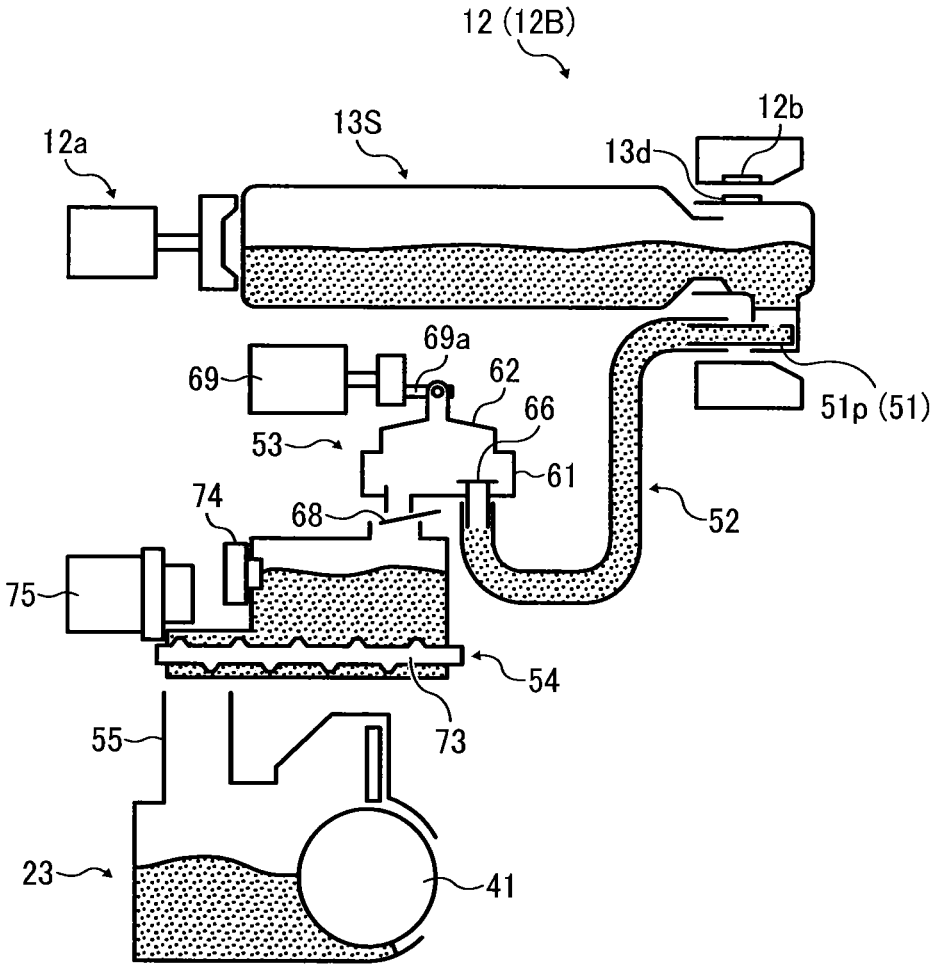
FIG. 9 is a schematic view illustrating a state in which the toner replenishing device transports toner contained in the toner container before replacement, according to an embodiment.

Referring to FIG. 3, the controller 34 is connected to the respective portions of the toner replenishing device 50 (such as the container mount 12, in particular, a driving mechanism 12*a* shown in FIG. 9), a toner amount detector 51*d* (i.e., connecting section sensor) provided to a toner reservoir 51*a* serving a replenishing device connecting section, the developing device 23 (in particular, a driving mechanism thereof), the conveyance pump 53 (a pump motor 69 thereof in particular), and the sub-hopper 54 (in particular, a toner end sensor 74 and a screw driving mechanism 75 shown in FIG. 9). According to the programs stored in the memory device 34*a*, the controller 34 controls the operation of the toner replenishing device 50 to replenish the developing device 23 with developer (e.g., toner) supplied from the toner container 13, conveyance channel cleaning in the toner replenishing device 50, and initial filling. The control of toner replenishment, conveyance channel cleaning, and initial filling are described in further detail later.

Operation of the developing device 23 is described below.

Toner supplied to the developer containing compartment 44 is mixed with developer therein, and the developer is circulated by the conveying screws 45 between the two developer containing compartments 43 and 44 (transported from one side to the other side in the direction perpendicular to the surface of the paper on which FIG. 2 is drawn). While developer is thus agitated, toner particles in the developer are charged by friction with carrier particles, adsorbed to the carrier particles, and scooped on the developing roller 41 by the magnetic force generated by the magnet inside the developing roller 41. In the developing roller 41, as the sleeve rotates, the scooped developer is transported to the position facing the doctor blade 42. Specifically, the amount of developer on the developing roller 41 is adjusted by the doctor blade 42, after which the developer is transported to the development range where the developing roller 41 faces the photoreceptor drum 21.

In the development range, carrier standing on the developing roller 41 slidingly contacts the surface of the photoreceptor drum 21. At that time, toner is charged negatively by friction with carrier. By contrast, carrier is charged positively. Additionally, a predetermined development bias is applied to the developing roller 41 from a power source. Thus, an electrical field is formed between the photoreceptor drum 21 and the developing roller 41. The electrical field causes the negatively charged toner to selectively adhere to an image portion (i.e., an electrostatic latent image) on the photoreceptor drum 21. Thus, the electrostatic latent image on the photoreceptor drum 21 is developed into a toner image. As the sleeve rotates, developer remaining on the developing roller 41 reaches the developer containing compartment 43. Then, due to a developer release pole, developer leaves the developing roller 41 and returns to the conveying screw 45. The developer release pole is formed where the magnet inside the developing roller 41 does not generate a magnetic pole. Alternatively, the developer release pole can be formed using a magnet having a magnetic pole arrangement to generate a repulsive magnetic field.

It is to be noted that the image forming apparatus 10 according to the present embodiment can be, for example, a multifunction image forming apparatus (i.e., MFP) including copying and printing capabilities. When the image forming apparatus 10 performs copying, image data is read by, for example, a scanner, and image processing, such as analog to digital conversion, MTF (Modulation Transfer Factor) correction, gradation processing, is performed. When the image forming apparatus 10 functions as a printer, image data in the form of page description language (PDL), bitmap, or the like transmitted from a computer or the like is processed into image writing data.

Next, the toner replenishing device 50 to supply toner contained in the toner container 13 to the developing device 23 is described in further detail below with reference to FIGS. 3 through 5B.

It is to be noted that, in FIG. 3, the image forming unit 15 is simplified and only the developing device 23 and the photoreceptor drum 21 are illustrated for ease of understanding. Additionally, as described below, the container mount 12A corresponding to the toner container 13Y, 13M, 13C, or 13Bk is illustrated in FIG. 3. The toner replenishing device 50 serves as a replenishing device or conveyance device to transport powder or fluid (i.e., developer or toner) from the container (i.e., toner container 13) containing the powder or fluid to a containing portion (i.e., sub-hopper 54 and developing device 23).

The respective color toners contained in the toner containers 13S, 13Y, 13M, 13C, and 13Bk in the respective container mounts 12 are supplied to the corresponding developing devices 23 according to the amount of toner consumed. The toner replenishing device 50 includes, in addition to the container mount 12, the toner conveying tube 52, the conveyance pump 53, the sub-hopper 54, and the toner conveying pipe 55. The toner replenishing device 50 further includes the replenishing device connecting section serving as a connection with the toner container 13, that is, a connection between the container mount 12 and the toner container 13 mounted therein. In the replenishing device 50 corresponding to the four color toners, the toner reservoir 51*a* serves as the replenishing device connecting section.

Figure 4A:
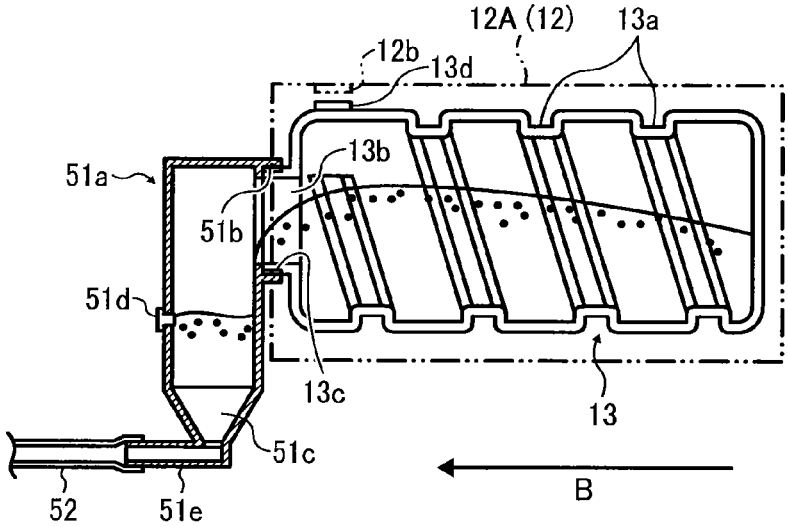
FIG. 4A is a schematic view illustrating a state in which a toner container is installed in a container mount corresponding to yellow, magenta, cyan, and black.
Figure 4B:
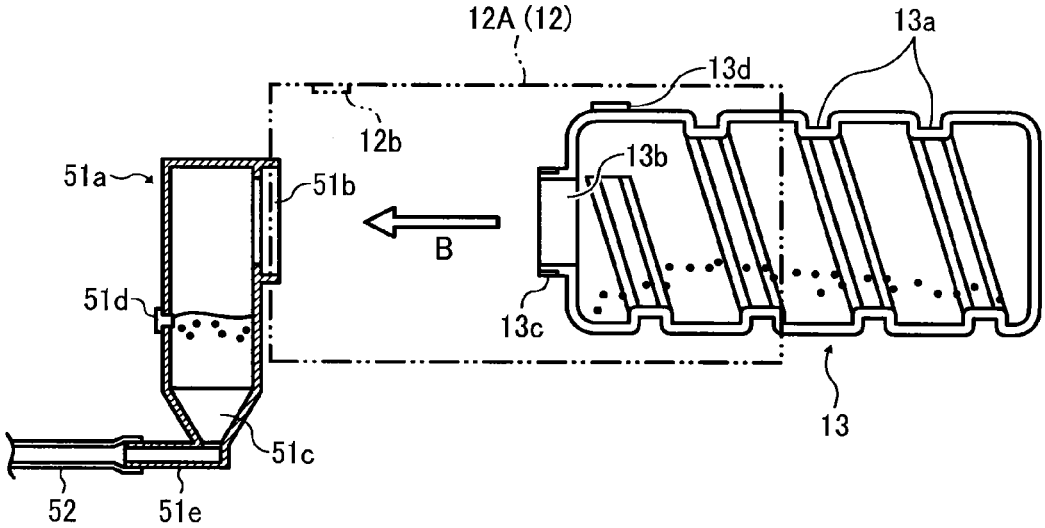
FIG. 4B is a schematic view illustrating a state in which the toner container is removed from the container mount shown in FIG. 4A.
Figure 5A:
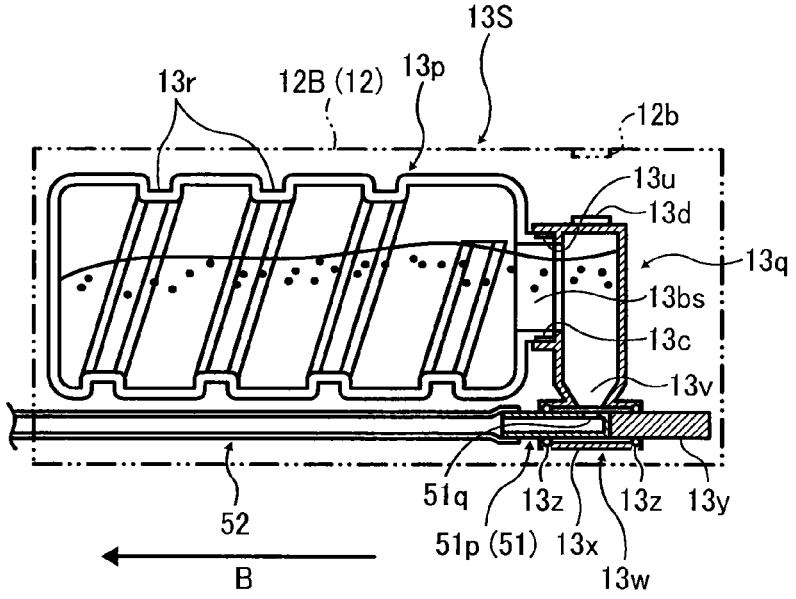
FIG. 5A is a schematic view illustrating a state in which a toner container for containing special toner is installed in a container mount corresponding to special toner.
Figure 5B:
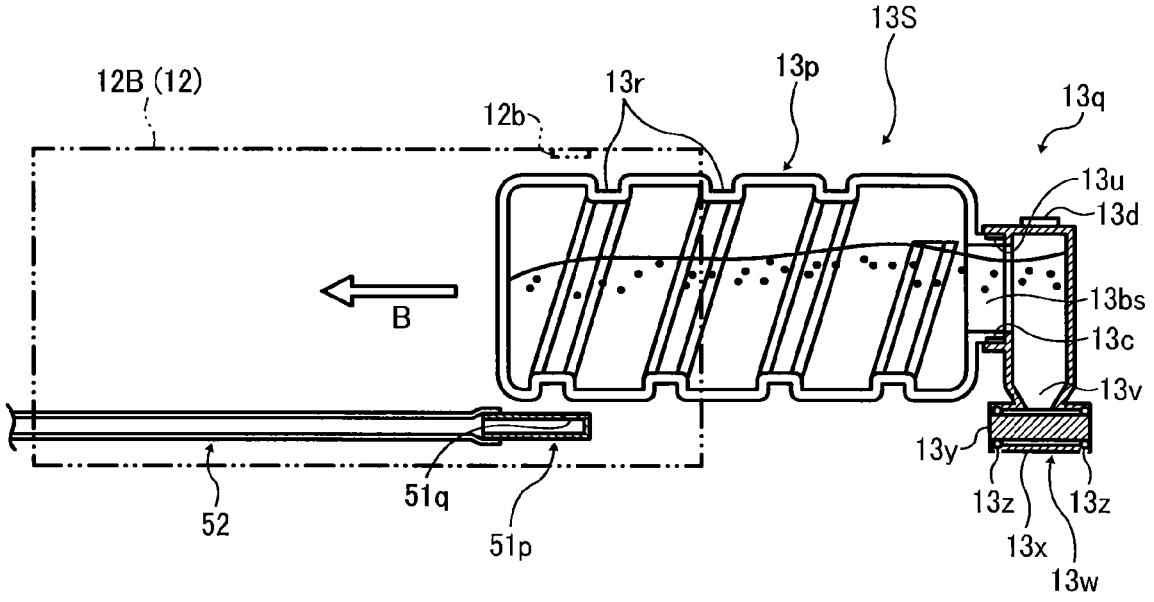
FIG. 5B is a schematic view illustrating a state in which the toner container for containing special toner is removed from the container mount shown in FIG. 5A.

In the present embodiment, there are two types of container mounts 12, namely, the container mounts 12A shown in FIGS. 3, 4A, and 4B and the container mount 12B shown in FIGS. 5A and 5B. The container mounts 12A corresponds to the toner containers 13Y, 13M, 13C, and 13Bk. The container mount 12B corresponds to the toner container 13S.

The different container mounts 12 are thus used because there is a need of changing special toner type, whereas such a need does not arise basically in case of yellow, magenta, cyan, and black toners. Additionally, since there is a need of replacing the toner container 13S mounted therein due to the change in special toner type, the container mount 12B is disposed at a position different from the four container mounts 12A and closest to the outside of the image forming apparatus 10 among the five container mounts 12 as shown in FIG. 1. It is to be noted that hereinafter the direction in which the toner container 13 is moved (inserted or installed) into the container mount 12 is referred to as "insertion direction", the front side in the insertion direction is referred to as "leading side in the insertion direction", and the opposite side thereof is referred to as "trailing side in the insertion direction".

FIG. 4A is a schematic view illustrating a state in which the toner container 13 is held in the container mount 12A, and FIG. 4B is a schematic view illustrating a state in which the toner container 13 is removed from the container mount 12A.

Referring to FIGS. 4A and 4B, the toner containers 13Y, 13M, 13C, and 13Bk mounted in the container mounts 12A are cylindrical entirely. In the outer circumferential face thereof, a spiral guide groove 13*a* is formed in a spiral centered about the center axis along the insertion direction indicated by arrow B in FIGS. 4A and 4B. The spiral guide groove 13*a* is a recess formed in the outer circumference face of the toner container 13 and is a spiral projection projecting inward from the inner circumferential face. With this configuration, when the toner container 13 rotates about the center axis thereof (as the center of rotation), toner therein can be transported in the insertion direction indicated by arrow B. In the toner container 13, a mouth 13*b* (i.e., an opening portion) enclosing an opening is provided on the leading side in the insertion direction indicated by arrow B. Through the mouth 13*b* (i.e., opening), the interior of the toner container 13 communicates with the outside of the toner container 13, and toner in the toner container 13 can be discharged through the mouth 13*b*. The mouth 13*b* can be closed by a plug. In the toner container 13, a sealing member 13*c* is provided enclosing the mouth 13*b* in the direction perpendicular to the insertion direction indicated by arrow B. The sealing member 13*c* is constructed of an elastic material, such as sponge, for example.

Additionally, the toner container 13 is provided with an electronic board 13*d* serving as a memory device. The electronic board 13*d* communicates with the image forming apparatus 10 (controller 34 in particular) for data transmission and reception via an antenna board 12*b* provided to the container mount 12A. The electronic board 13*d* can include radio frequency identification (RFID). The data exchanged includes, for example, the production serial number of the toner container, the number of times the toner container is reused, the production lot number, the production date, the type (such as color) of toner contained, and usage history of the image forming apparatus 10. Other data may also be included. Further, data including the amount of toner remaining in the toner container 13 is written in the electronic board 13*d* as required by the antenna board 12*b* in accordance with the amount of toner consumed. When the toner container 13 is mounted in the container mount 12A properly, communication between the electronic board 13*d* and the antenna board 12*b* is available. Accordingly, in the present embodiment, the antenna board 12*b* together with the electronic board 13*d* can serve as an installation completion detector to detect whether the toner container 13 is mounted in the container mount 12A properly.

It is to be noted that the installation completion detector is not limited to the above-described configuration as long as proper installation of the toner container 13 in the container mount 12A can be detected. For example, the electronic board 13*d* may be replaced by an identifier, such as a barcode, that can be read as digital data in a contactless state, and the antenna board 12*b* may be replaced by a data reader to read the digital data of the identifier. Alternatively, the installation completion detector may includes a contact-type switch that outputs a installation detection signal when it contacts the toner container 13 as the toner container 13 is mounted in the container mount 12A properly. Yet alternatively, an optical sensor such as a reflection sensor may be used. It is to be noted that, when the contact-type switch or the optical sensor is used, data transmission and reception with the image forming apparatus 10 (the controller 34) is not available, and accordingly toner type data indicating the type of toner contained in the toner container 13 is not acquired using those components.

In the toner replenishing device 50, the toner reservoir 51*a* serving as the replenishing device connecting section for the container mount 12A stores toner discharged from the toner container 13Y, 13M, 13C, or 13Bk. The toner reservoir 51*a* is cylindrical and long in a vertical direction, and an upper end thereof is closed. The toner reservoir 51*a* includes a connection portion 51*b* in an upper section thereof and a funnel portion 51*c* in a lower section thereof, and the toner amount detector 51*d* is positioned at an intermediate position thereof. An opening is formed in the connection portion 51*b* to open the interior of the toner reservoir 51*a* to the outside of the toner reservoir 51*a*, and the mouth 13*b* of the toner container 13 can fit in the connection portion 51*b*. When the mouth 13*b* is fitted in the container connection portion 51*b*, clearance therebetween can be sealed by the sealing member 13*c*. The sealed state by the sealing member 13*c* can be kept even when the mouth 13*b* (i.e., toner container 13) rotates relative to the connection portion 51*b* of the toner reservoir 51*a*.

The funnel portion 51*c* is funneled with its inner diameter decreasing downward, and a cylindrical connecting compartment 51*e* is provided to a lower end thereof. An interior of the cylindrical connecting compartment 51*e* communicates with an interior of the funnel portion 51*c* of the toner reservoir 51*a* at a first end thereof, and a second end thereof is connected to the toner conveying tube 52. The toner amount detector 51*d* provided to the toner reservoir 51*a* detects the amount of toner contained in the toner reservoir 51*a* and can transmit signals indicating the detection results to the controller 34 (see FIG. 3).

In the container mount 12A, when the toner container 13 is inserted in the direction indicated by arrow B from the side of the mouth 13*b* as shown in FIG. 4B, the mouth 13*b* is fitted in the connection portion 51*b*, and the toner container 13 is mounted therein as shown in FIG. 4A. At that time, the toner container 13 receives driving force from the driving mechanism 12*a* (shown in FIG. 9) provided to the container mount 12A. In the container mount 12A, the driving mechanism 12*a* rotates the toner container 13, being controlled by the controller 34 (shown in FIG. 3). Then, toner in the toner container 13 is discharged from the mouth 13*b*, transported via the connection portion 51*b* to the interior of the toner reservoir 51*a*, and temporarily stored in the toner reservoir 51*a*. Thus, the driving mechanism 12*a* can serve as a discharge driving unit to drive the toner container 13 to discharge toner from the toner container 13 mounted. The controller 34 drives the driving mechanism 12*a* of the container mount 12A according to the detection signals transmitted from the toner amount detector 51*d* so that the amount of toner in the toner reservoir 51*a* (including the funnel portion 51*c*) can be kept constant. The amount of toner in the toner reservoir 51*a* (including the funnel portion 51*c*) is kept constant to enable smooth transport of toner to the toner conveying tube 52 by a pressure difference caused by the conveyance pump 53. Toner (one of the four color toners) can move from the toner reservoir 51*a* to the cylindrical connecting compartment 51*e* and further to the toner conveying tube 52 connected to the cylindrical connecting compartment 51*e*.

FIG. 5A is a schematic view illustrating a state in which the toner container 13S for containing special toner is held in the container mount 12B corresponding to special toner, and FIG. 5B is a schematic view illustrating a state in which the toner container 13S is removed from the container mount 12B.

Referring to FIGS. 5A and 5B, the toner containers 13S mounted in the container mount 12B includes a container body 13*p* that is cylindrical entirely and a container-side connecting section 13*q* on the trailing side in the insertion direction indicated by arrow B. In the outer circumferential face of the container body 13*p*, a spiral guide groove 13*r* is formed in a spiral centered about the center axis along the insertion direction indicated by arrow B. The spiral guide groove 13*r* is a recess formed in the outer circumference face of the container body 13*p* and is a spiral projection projecting inward from the inner circumferential face. With this configuration, when the container body 13*p* rotates about the center axis thereof (as the center of rotation), toner therein can be transported in the insertion direction indicated by arrow B. A mouth 13*bs* is provided on the trailing side of the container body 13*p* in the insertion direction thereof. Through the mouth 13*bs* (i.e., opening), the interior of the container body 13*p* communicates with the outside of the container body 13*p*, and toner therein can be discharged through the mouth 13*bs*. The mouth 13*bs* can be closed by a plug. In the container body 13*p*, a sealing member 13*c* is provided enclosing the mouth 13*bs* in the direction perpendicular to the insertion direction indicated by arrow B. The sealing member 13*c* is constructed of an elastic material, such as sponge, for example.

The container-side connecting section 13*q* is cylindrical and coaxial with the container body 13*p*, and an end (on the right in FIGS. 5A and 5B) of the container-side connecting section 13*q* opposite the container body 13*p* is closed. The container-side connecting section 13*q* includes a connection portion 13*u* in an upper section thereof and a funnel portion 13*v* in a lower section thereof. A shutter section 13*w* is provided to a lower end of the container-side connecting section 13*q*. An opening is formed in the connection portion 13*u* to open the cylindrical interior of the container-side connecting section 13*q* to the outside of container-side connecting section 13*q*, and the mouth 13*bs* of the container body 13*p* can fit in the connection portion 13*u*. When the mouth 13*bs* is fitted in the connection portion 13*u*, clearance therebetween can be sealed by the sealing member 13*c*. The sealed state by the sealing member 13*c* can be kept even when the mouth 13*bs* (i.e., container body 13*p*) rotates relative to the connection portion 13*u* of the container-side connecting section 13*q*.

The funnel portion 13*v* is funneled with its inner diameter decreasing downward. The shutter section 13*w* at the lower end includes a cylindrical compartment 13*x* and a shutter (or plug) 13*y*. An interior of the cylindrical compartment 13*x* communicates with the interior of the funnel portion 13*v* (i.e., container-side connecting section 13*q*). A ring-shaped sealing member 13*z* is provided to the inner circumferential face of the cylindrical compartment 13*x*.

The shutter 13*y* is columnar and can be inserted into the cylindrical compartment 13*x* (including the sealing member 13*z*). The cylindrical compartment 13*x* includes a communicating portion with the funnel portion 13*v* (container-side connecting section 13*q*), and the shutter 13*y* has dimensions to close the communicating portion together with the sealing member 13*z*. The shutter 13*y* is movable between a closing position (shown in FIG. 5B) where the shutter 13*y* closes the communicating portion of the cylindrical compartment 13*x* with the funnel portion 13*v* and an open position (shown in FIG. 5A, on the trailing side in the insertion direction) where the shutter 13*y* opens the communication portion. The shutter 13*y* is urged in the direction from the open position to the closing direction and is moved from the closing position to the open position by an external force.

Additionally, the container body 13*p* of the toner container 13S is provided with an electronic board 13*d* similarly to the toner containers 13Y, 13M, 13C, and Bk. The electronic board 13*d* of the toner container 13S communicates with the image forming apparatus 10 (the controller 34 thereof) for data transmission and reception via an antenna board 12*b* provided to the container mount 12B. When the toner container 13S is mounted in the container mount 12B properly, communication between the electronic board 13*d* and the antenna board 12*b* is available. Accordingly, in the present embodiment, the antenna board 12*b* together with the electronic board 13*d* can serve as an installation completion detector to detect whether the toner container 13S is mounted in the container mount 12B properly. It is to be noted that the installation completion detector is not limited to the above-described configuration as long as proper installation of the toner container 13S in the container mount 12B can be detected as described above concerning the container mount 12A.

In the toner replenishing device 50 corresponding to the container mount 12B and the toner container 13S, a nozzle 51*p* serves as the replenishing device connecting section. The nozzle 51*p* is columnar and can be inserted into the cylindrical compartment 13*x* (including the sealing member 13*z*) of the container-side connecting section 13*q*. An end of the nozzle 51*p* on the trailing side in the insertion direction is closed, and the other end thereof is connected to the toner conveying tube 52. The nozzle 51*p* has an inner diameter identical or substantially identical to that of the toner conveying tube 52. The nozzle 51*p* has dimensions to close the communicating portion of the cylindrical compartment 13*x* communicating with the outside of the cylindrical compartment 13*x* together with the sealing member 13*z* when the nozzle 51*p* is inserted into the cylindrical compartment 13*x* (including the sealing member 13*z*) of the container-side connecting section 13*q*. In the nozzle 51*p*, a connection opening 51*q* is formed adjacent to the closed end (on the right in FIGS. 5A and 5B) on the trailing side in the insertion direction. Through the connection opening 51*q*, an interior of the nozzle 51*p* communicates with the outside of the nozzle 51*p*. Inside the cylindrical compartment 13*x* of the container body 13*p*, the interior of the nozzle 51*p* can communicate with the interior of the funnel portion 13*v* (container-side connecting section 13*q*) through the connection opening 51*q* as shown in FIG. 5A.

In the container mount 12B, when the toner container 13S is inserted in the direction indicated by arrow B from the side of the container body 13*p* opposite the container-side connecting section 13*q* as shown in FIG. 5B, the nozzle 51*p* is fitted in the shutter section 13*w* of the container-side connecting section 13*q*, and the toner container 13S is mounted therein as shown in FIG. 5A. At that time, the nozzle 51*p* is relatively inserted from the leading side in the insertion direction into the cylindrical compartment 13*x* of the shutter section 13*w*. The nozzle 51*p* pushes the shutter 13*y* being at the closing position to the trailing side in the insertion direction. Thus, the shutter 13*y* moves from the closing position shown in FIG. 5B to the open position shown in FIG. 5A. When the shutter 13*y* is at the open position, as shown in FIG. 5A, the connection opening 51*q* of the nozzle 51*p* is disposed at the position communication with the interior of the funnel portion 13*v* (container-side connecting section 13*q*). Then, the nozzle 51*p* is connected to the shutter section 13*w* of the container-side connecting section 13*q* so that the interior of the funnel portion 13*v* (container-side connecting section 13*q*) communicates via the connection opening 51*q* with the interior of the nozzle 51*p*. In this state, the toner container 13S receives driving force from the driving mechanism 12*a* (shown in FIG. 9) provided to the container mount 12B.

In the container mount 12B, the driving mechanism 12*a* rotates the container body 13*p* of the toner container 13S, being controlled by the controller 34 (shown in FIG. 3). Then, toner in the container body 13*p* is discharged from the mouth 13*bs*, transported via the connection portion 13*u* to the interior of the container-side connecting section 13*q*, and temporarily stored in the container-side connecting section 13*q*. Toner (special toner) can move from the toner container 13S via the connection opening 51*q* to the nozzle 51*p* and further to the toner conveying tube 52 connected to the nozzle 51*p*. Thus, the driving mechanism 12*a* can serve as a discharge driving unit to drive the toner container 13S (container body 13*p* in particular) to discharge toner from the toner container 13S mounted. Additionally, when the toner container 13S is moved to the trailing side in the insertion direction relative to the container mount 12B and removed therefrom, the shutter 13*y* of the shutter section 13*w* is released from the force exerted by the nozzle 51*p* pushing the shutter 13*y* to the trailing side in the insertion direction. Accordingly, in the toner container 13S (container-side connecting section 13*q* in particular), the shutter 13*y* moves from the open position to the closing position, thereby closing the communication portion of the cylindrical compartment 13*x* communicating with the funnel portion 13*v* (container-side connecting section 13*q*) as shown in FIG. 5B.

Configurations of portions of the toner replenishing device 50 not described yet are similar regardless of toner type, that is, which of the toner reservoir 51*a* (corresponding to the container mount 12A) and the nozzle 51*p* (corresponding to the container mount 12B) is used as the replenishing device connecting section. Therefore, the suffixes S, Y, M, C, and Bk attached to each reference numeral indicating special toner, yellow, magenta, cyan, and black, respectively, are omitted in the descriptions below with reference to FIGS. 3 and 6

The toner conveying tube 52 serves as a conveyance channel to guide toner from the toner container 13 mounted in the container mount 12 to the containing portion, namely, the sub-hoppers 54 and the developing devices 23. Locations of the container mounts 12 in the image forming apparatus 10 are determined in view of ease of installation (e.g., insertion) of the corresponding toner container 13 and compactness of the apparatus. Additionally, location of each developing device 23 (image forming unit 15) in the image forming apparatus 10 is determined in view of the compactness of the apparatus while securing proper multicolor image formation using the intermediate transfer belt 14*a*. Accordingly, the toner conveying tube 52 passes between various components inside the image forming apparatus 10 to connect the container mount 12 (replenishing device connecting section therein) to the developing device 23 and the sub-hopper 54 corresponding to the color (type) of toner of the container mount 12. In particular, in the present embodiment, the image forming unit 15S is positioned extreme upstream among the image forming units 15S, 15Y, 15M, 15C, and 15Bk in the direction in which the intermediate transfer belt 14*a* (shown in FIG. 1) rotates. In addition, in the present embodiment, the container mount 12B is at the position closest to the outside of the image forming apparatus 10 among the five container mounts 12. Therefore, in the image forming apparatus 10, the toner conveying tube 52 connecting the container mount 12B to the developing device 23S is longer as shown in FIG. 1. The toner conveying tubes 52 are formed with a flexible material having good resistance against toner, and the second end of each toner conveying tube 52 opposite the first end connected to the toner container 13 is connected to the conveyance pump 53.

Figure 6:
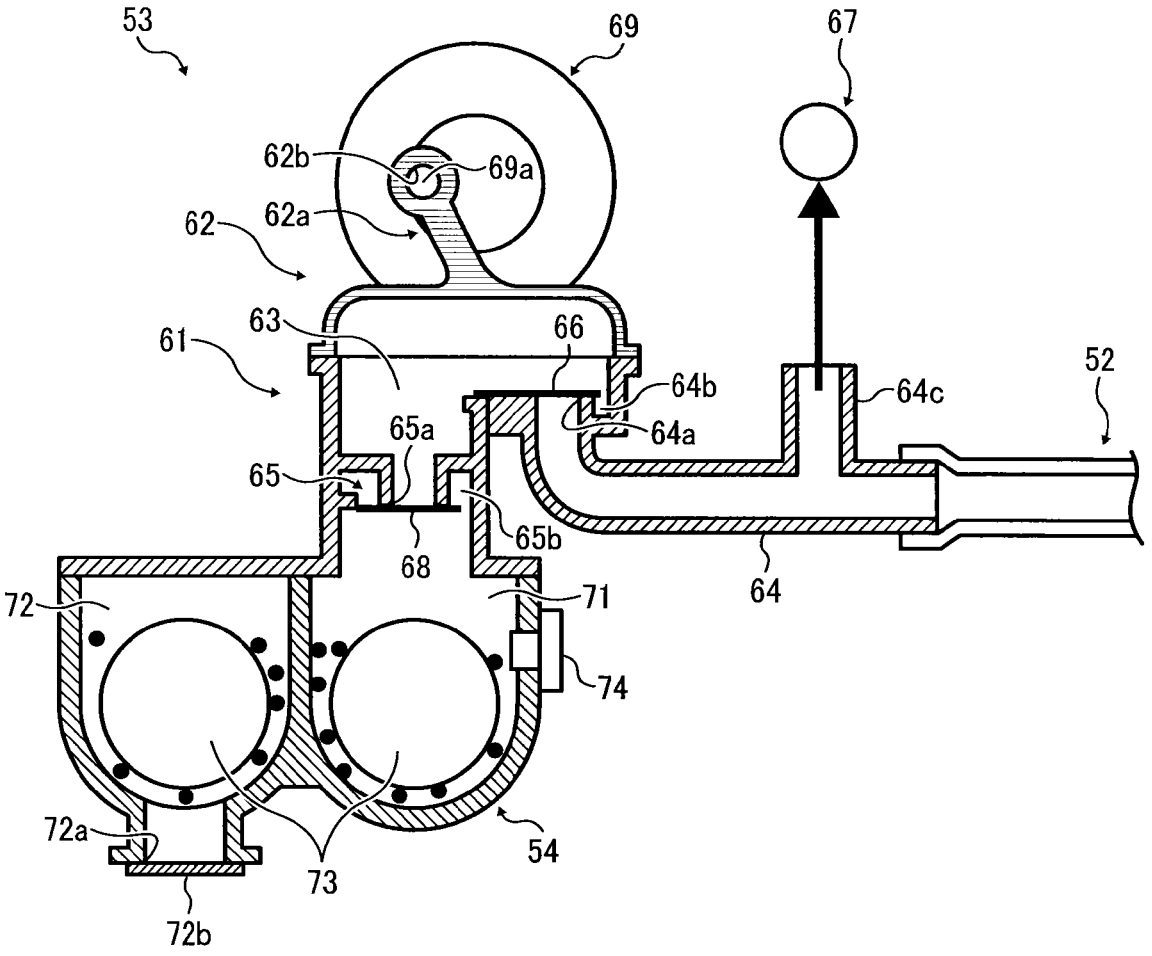
FIG. 6 is a schematic view illustrating a configuration of a conveyance pump and a sub-hopper.

FIG. 6 is a schematic view illustrating a configuration of the conveyance pump 53 and the sub-hopper 54.

The conveyance pump 53 causes a pressure difference, thereby transporting powder or fluid (toner in the present embodiment) from the container mount 12, namely, the toner container 13, to the containing portion, namely, the sub-hopper 54 and the developing device 23, through the toner conveying tube 52 serving as the conveyance channel. Thus, the conveyance pump 53 serves as a driving mechanism to transport powder or fluid. In the present embodiment, the conveyance pump 53 is disposed on the second end side of the toner conveying tube 52, that is, on the side of the containing portion, and transports powder or fluid by suction. It is to be noted that, alternatively, the conveyance pump 53 may be disposed on the first end side of the toner conveying tube 52, on which the replenishing device connecting section is positioned, and configured to transport powder or fluid by blowing.

The conveyance pump 53 in the present embodiment is a diaphragm pump as shown in FIG. 6 and includes a case 61 and a diaphragm 62 provided to the case 61. The case 61 is shaped like a box that is open on a first end, and the diaphragm 62 is provided to the open first end. The case 61 forms an operation chamber 63 in cooperation with the diaphragm 62. In the case 61, a sucking-in channel 64 and a discharge channel 65, both communicating with the operation chamber 63, are formed.

The sucking-in channel 64 connects the operation chamber 63 to the toner conveying tube 52, and the toner conveying tube 52 is removably connected to a first end of the sucking-in channel 64. A suction inlet 64*a* is formed at the other end (i.e., second end) of the sucking-in channel 64. A suction valve 66 as a so-called non-return valve is provided to the suction inlet 64*a* to allow passage of powder and fluid from the sucking-in channel 64 to the operation chamber 63 and blocks passage of powder and fluid from the operation chamber 63 to the sucking-in channel 64. An escape groove 64*b* is formed enclosing the periphery of the suction inlet 64*a* of the sucking-in channel 64, on the side (i.e., second end side) of the operation chamber 63. The escape groove 64*b* reduces a contact area between the suction valve 66 and the suction inlet 64*a* and provides a refuge for the powder or fluid present between the suction valve 66 and the suction inlet 64*a*. With this configuration, the suction valve 66 can close the suction inlet 64*a*. The sucking-in channel 64 further includes a bifurcation channel 64*c* at an intermediate position between the first and second ends. The bifurcation channel 64*c* is provided for a pressure gauge 67 to detect pressure inside the sucking-in channel 64. The pressure gauge 67 can transmit detection signals to the controller 34 shown in FIG. 3.

The discharge channel 65 connects the operation chamber 63 to the sub-hopper 54 (in particular, a developer chamber 71 thereof). A first end of the discharge channel 65 communicates with the operation chamber 63, and a second end thereof forms a discharge outlet 65*a* and connects to the sub-hopper 54. A discharge valve 68 as a so-called non-return valve is provided to the discharge outlet 65*a* to allow passage of powder and fluid from the discharge channel 65 to the sub-hopper 54 and blocks passage of powder and fluid from the sub-hopper 54 to the discharge channel 65. In the discharge channel 65, an escape groove 65*b* is formed enclosing the periphery of the discharge outlet 65*a* on the side of the sub-hopper 54. The escape groove 65*b* reduces a contact area between the discharge valve 68 and the discharge outlet 65*a* and provides a refuge for the powder or fluid present between the discharge valve 68 and the discharge outlet 65*a*. With this configuration, the discharge valve 68 can close the discharge outlet 65*a*.

The diaphragm 62 is formed with a flexible material and attached to the case 61 to close its open end. The diaphragm 62 can move between a position withdrawn into the case 61, that is, toward the operation chamber 63, and a position protruding outward from the case 61. A transmission arm 62*a* is provided to a center portion of the diaphragm 62. The transmission arm 62*a* is for moving the diaphragm 62 between the above-described two positions. A shaft hole 62*b* is formed at a projecting end of the transmission arm 62*a*. The pump motor 69 applies power to the diaphragm 62 via the transmission arm 62*a*.

The pump motor 69 is connected to the controller 34 (shown in FIG. 3) and is driven, controlled by the controller 34. The pump motor 69 includes a crank shaft 69*a*, as an output shaft, that is shifted (i.e., eccentric) from the center of rotation, and the crank shaft 69*a* is inserted into the shaft hole 62*b* of the transmission arm 62*a* of the diaphragm 62. Being controlled by the controller 34, the pump motor 69 consecutively moves the diaphragm 62 of the conveyance pump 53 between the above-described two positions, thereby driving the conveyance pump 53. Accordingly, in the conveyance pump 53, the volume of the operation chamber 63 increases and decreases consecutively, and powder or fluid can be sucked in from the suction inlet 64*a* (sucking-in channel 64) and discharged from the discharge outlet 65*a* (discharge channel 65). The controller 34 controls driving of the conveyance pump 53 according to the detection signals from the toner end sensor 74 and the pressure gauge 67.

The sub-hopper 54 connected to the discharge outlet 65*a* includes the developer chambers 71 and 72, the two conveying screws 73 respectively provided therein, and the toner end sensor 74 to detect the amount of toner in the developer chamber 71. The sub-hopper 54 temporarily stores toner supplied by the conveyance pump 53 from the toner container 13 through the toner conveying tube 52 to adjust the amount of toner supplied to the developing device 23. Thus, the sub-hopper 54 serves as a temporary containing portion for temporarily storing powder or fluid supplied to the containing portion.

The developer chamber 71 communicates with the discharge outlet 65*a* of the conveyance pump 53, and toner discharged by the conveyance pump 53 drops under the gravity to the developer chamber 71. Toner thus supplied is then agitated and circulated between the developer chambers 71 and 72 by the conveying screws 73 while being transported from one side to the other side in the direction perpendicular to the surface of the paper on which FIG. 6 is drawn. The two conveying screws 73 are driven by the screw driving mechanism 75 (shown in FIG. 9). The screw driving mechanism 75 is connected to the controller 34 (shown in FIG. 3) and controlled by the controller 34.

The developer chamber 72 is connected to the toner conveying pipe 55 (shown in FIG. 3) via an opening 72*a* beneath the developer chamber 72. The toner conveying pipe 55 is connected to the developer containing compartment 44 of the developing device 23 as shown in FIG. 3. Accordingly, when the toner circulated by the two conveying screws 73 is moved in the developer chamber 72 to the position above the opening 72*a*, toner moves down the toner conveying pipe 55 under the gravity and can be supplied to the developer containing compartment 44 of the developing device 23. Thus, the two conveying screws 73 together form a developer supplying member of the temporary containing portion to supply powder or fluid to the destination, that is, the developing device 23.

The toner end sensor 74 serves as a developer amount detector to detect the amount of powder or fluid in the temporary containing portion of the containing portion. The toner end sensor 74 in the present embodiment detests the amount of toner (i.e., whether the predetermined amount of toner is present) by detecting changes in pressure and is disposed at a predetermined height of the developer chamber 71. When the level of toner reaches the position (i.e., height) of the toner end sensor 74, the toner end sensor 74 detects pressure thereof, thereby determining that the predetermined amount of toner is present in the developer chamber 71. Then, the toner end sensor 74 outputs a toner detection signal. The toner end sensor 74 is connected to the controller 34 (shown in FIG. 3) and outputs electric signals indicating results of pressure detection (e.g., toner detection signal) thereto. The controller 34 according to the present embodiment detects the detection signal from the toner end sensor 74 multiple number of times (ten times for example) within a predetermined period of time. When the toner detection signal is not detected predetermined number of times (five times for example), the controller 34 deems that the amount of toner in the developer chamber 71 is insufficient.

Figure 12:
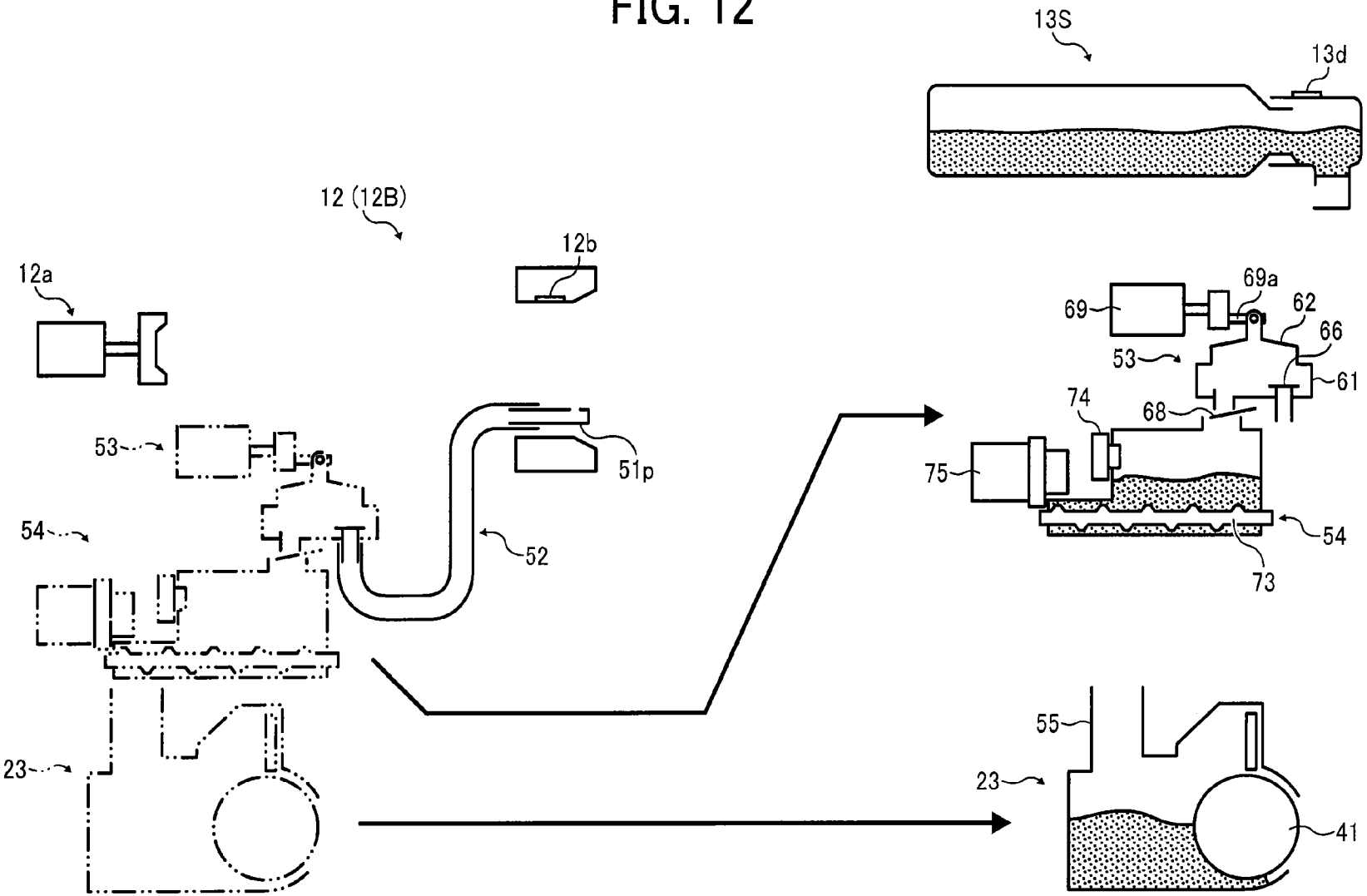
FIG. 12 is an exploded view of the toner replenishing device shown in FIGS. 3, 5A, and 5B, illustrating a state in which the conveyance pump, the sub-hopper, and the developing device are removed after completion of the conveyance channel cleaning.

It is to be noted that, the conveyance pump 53 and the sub-hopper 54 are assembled into a single modular unit removable from the image forming apparatus 10 (housing 11) as shown in FIG. 12. The toner conveying pipe 55 can be removed from the opening 72*a* positioned beneath the developer chamber 72 of the sub-hopper 54, and a shutter piece 72*b* is provided to close the opening 72*a* from which the toner conveying pipe 55 is removed. When the toner conveying pipe 55 is attached to the opening 72*a*, the shutter piece 72*b* opens the opening 72*a*. Additionally, the toner conveying tube 52 can be removed from the first end of the sucking-in channel 64. Therefore, the conveyance pump 53 and the sub-hopper 54 can be replaced easily.

Next, descriptions are given below of toner replenishment executed by the toner replenishing device 50 to supply toner from the toner container 13 to the corresponding developing device 23. The controller 34 shown in FIG. 3 controls the toner replenishment executed by the toner replenishing device 50. The toner replenishment is executed to keep the amount of toner in the developing device 23 (developer containing compartment 44 in particular) within a predetermined range.

When the density sensor 46 of the developing device 23 detects that the concentration of toner in developer in the developer containing compartment 44 is smaller than the predetermined value, the toner replenishing device 50 drives the screw driving mechanism 75 (shown in FIG. 9) to rotate the two conveying screws 73 in the sub-hopper 54. Then, in the sub-hopper 54, toner is agitated and circulated between the developer chambers 71 and 72. When toner reaches the opening 72*a* of the developer chamber 72, toner drops under the gravity to the toner conveying pipe 55. Then, the toner is supplied through the toner conveying pipe 55 to the developer containing compartment 44 of the developing device 23. When the density sensor 46 detects that the concentration of toner in developer in the developer containing compartment 44 is adjusted to the predetermined value, the toner replenishing device 50 stops rotation of the two conveying screws 73 driven by the screw driving mechanism 75.

In the sub-hopper 54, the mount of toner in the developer chambers 71 and 72 decreases as toner is supplied to the developer containing compartment 44 of the developing device 23. Accordingly, in the toner replenishing device 50, the pump motor 69 is driven to drive the conveyance pump 53 when the toner end sensor 74 detects that the amount of toner in the developer chamber 71 is insufficient. Then, the conveyance pump 53 sucks in air (including toner) inside the toner conveying tube 52 through the sucking-in channel 64, thereby causing a negative pressure inside the toner conveying tube 52 and generating sucking-in force to the suction inlet 64*a*. Accordingly, toner in the replenishing device connecting section connected to the toner container 13 is sucked in together with air through the toner conveying tube 52 to the suction inlet 64*a* of the conveyance pump 53. Toner is further transported from the suction inlet 64*a* to the operation chamber 63 of the conveyance pump 53 and discharged from the discharge outlet 65*a* (discharge channel 65) of the conveyance pump 53. Since the discharge outlet 65*a* communicates with the developer chamber 71 of the sub-hopper 54, toner discharged therefrom can be supplied to the developer chamber 71 of the sub-hopper 54. When the toner end sensor 74 detects that the amount of toner in the developer chamber 71 is increased to the predetermined amount (toner amount is sufficient), the toner replenishing device 50 stops driving of the conveyance pump 53 by the pump motor 69.

In the toner replenishing device 50 according to the present embodiment, the conveyance pump 53 is driven intermittently using the pump motor 69. That is, the toner replenishing device 50 repeats an intermittent driving cycle such that the conveyance pump 53 is stopped after driven a predetermined consecutive driving duration (for example, 0.7 seconds) and stopped, and is driven again the predetermined consecutive driving duration after a predetermined interval time. The intermittent driving cycle is repeated from the following reason.

In the present embodiment, a diaphragm pump is used as the conveyance pump 53 to transport toner through the toner conveying tube 52 from the toner container 13 mounted in the container mount 12 (i.e., replenishing device connecting section thereof) to the developing device 23 in the image forming unit 15. The conveyance pump 53 has a high capability (i.e., conveyance capability) to suck in powder or fluid from the suction inlet 64*a* (sucking-in channel 64) and discharge powder or fluid from the discharge outlet 65*a* (discharge channel 65). Therefore, it is possible that the developer chamber 71 of the sub-hopper 54 is filled with toner in a very short time unless the conveyance pump 53 is driven intermittently. Additionally, since toner is discharged from the conveyance pump 53 rather strongly to the developer chamber 71, air is mixed in toner immediately after discharged, thus increasing the bulk of toner. Then, it is difficult for the toner end sensor 74 to properly detect the amount of toner in the developer chamber 71. Accordingly, the conveyance pump 53 is driven at certain intervals to let the increases in bulk of toner dissolve to enable the toner end sensor 74 to properly detect the amount of toner in the developer chamber 71. Thus, the conveyance pump 53 is driven by the pump motor 69 by repeating the intermittent driving cycle.

The toner conveying tube 52 is connected to the replenishing device connecting section (toner reservoir 51*a* in FIGS. 4A and 4B or nozzle 51*p* in FIGS. 5A and 5B) connected to the toner container 13 mounted in the container mount 12. The configuration of the replenishing device connecting section (toner reservoir 51*a*) of the container mounts 12A for yellow, magenta, cyan, and black toners is different from that of the replenishing device connecting section (nozzle 51*p*) of the container mount 12B for special toner.

In the toner reservoir 51*a* corresponding to the container mount 12A, when the toner amount detector 51*d* transmits a detection signal indicating that the amount of toner in the toner reservoir 51*a* falls below the predetermined amount, the toner container 13 is rotated by the driving mechanism 12*a*. Then, toner is discharged from the mouth 13*b* of the toner container 13 to the toner reservoir 51*a* via the connection portion 51*b*. When the toner amount detector 51*d* detects that the amount of toner in the toner reservoir 51*a* reaches the predetermined amount, the driving mechanism 12*a* is stopped. Thus, the amount of toner temporarily stored in the toner reservoir 51*a* can be kept constant. Toner can move from the toner reservoir 51*a* to the cylindrical connecting compartment 51*e* and further to the toner conveying tube 52 connected to the cylindrical connecting compartment 51*e*.

In the toner replenishing device 50 corresponding to the container mount 12B (shown in FIGS. 5A and 5B), the container body 13*p* of the toner container 13S is rotated by the driving mechanism 12*a* (shown in FIG. 9) according to the driving of the conveyance pump 53. Then, toner in the container body 13*p* is discharged from the mouth 13*bs*, transported via the connection portion 13*u* to the interior of the container-side connecting section 13*q*, and temporarily stored in the container-side connecting section 13*q*. Toner can move from the container-side connecting section 13*q* via the connection opening 51*q* to the nozzle 51*p* and further to the toner conveying tube 52 connected to the nozzle 51*p*.

Thus, in the toner replenishment controlled by the controller 34, the toner replenishing device 50 can adjust the amount of toner in the portion from the toner conveying tube 52 to the replenishing device connecting section by rotating the toner container 13 or the container body 13*p* as required. Accordingly, the toner replenishing device 50 can transport toner through the toner conveying tube 52 to the container mount 12, that is, from the toner container 13 to the sub-hopper 54, by driving the conveyance pump 53. The amount of toner in the sub-hopper 54 (in particular, the developer chamber 71 therein) can be adjusted by driving the conveyance pump 53. The toner replenishing device 50 can transport toner from the developer chamber 72 of the sub-hopper 54 through the toner conveying pipe 55 to the developing device 23 (in particular, the developer containing compartment 44 therein) by rotating the two conveying screws 73 in the sub-hopper 54. Since toner is transported to the developing device 23 by rotation of the two conveying screws 73, the amount of toner transported can be adjusted easily. Thus, the toner replenishing device 50 can keep the concentration of toner in developer in the developer containing compartment 44 within the predetermined or desirable range by performing the toner replenishment.

It is to be noted that there are cases where the toner end sensor 74 does not transmit the toner detection signal even if the toner container 13 or the container body 13*p* and the conveyance pump 53 are driven. Then, the controller 34 (toner replenishing device 50) detects "toner end" deeming that the toner container 13 (container body 13*p*) becomes empty or almost empty (toner end), that is, all or almost all toner therein has been consumed. Detecting "toner end" in the toner container 13, the controller 34 can alert the user to prompt the user to replace the toner container 13 by displaying a message on a display or turning on a light of a specific portion (such as the control panel 35 shown in FIG. 3). Even when "toner end" is detected, toner remains in the portion from the sub-hopper 54 via the toner conveying pipe 55 to the developing device 23. Accordingly, even if the toner container 13 is not replaced immediately, toner can be supplied for a certain period to the developing device 23, and image formation can be possible for a while. Additionally, since "toner end" in the toner container 13 is detected based on the amount of toner in the sub-hopper 54 (developer chamber 71), the time of "toner end" can be detected properly even if the toner container 13 is not provided with a toner end sensor.

Next, descriptions are given below of conveyance channel cleaning executed in the toner replenishing device 50 to remove special toner from the conveyance channel through which special toner is transported from the toner container 13S to the developing device 23S.

The conveyance channel cleaning is executed in the toner replenishing device 50, controlled by the controller 34. In the conveyance channel cleaning according to the present embodiment, the channel including the nozzle 51*p* (serving as a connection with the toner conveying tube 52) is cleaned. That is, the portion cleaned in the conveyance channel cleaning is in the toner replenishing device 50 (container mount 12B) corresponding to the toner container 13S for containing special toner. The channel corresponding to special toner is thus cleaned since it is possible that special toner type is changed, whereas toner type is not changed in the toner replenishing device 50 for yellow, magenta, cyan, and black toners.

The conveyance channel cleaning is described with reference to FIGS. 7 and 8.

Figure 7:
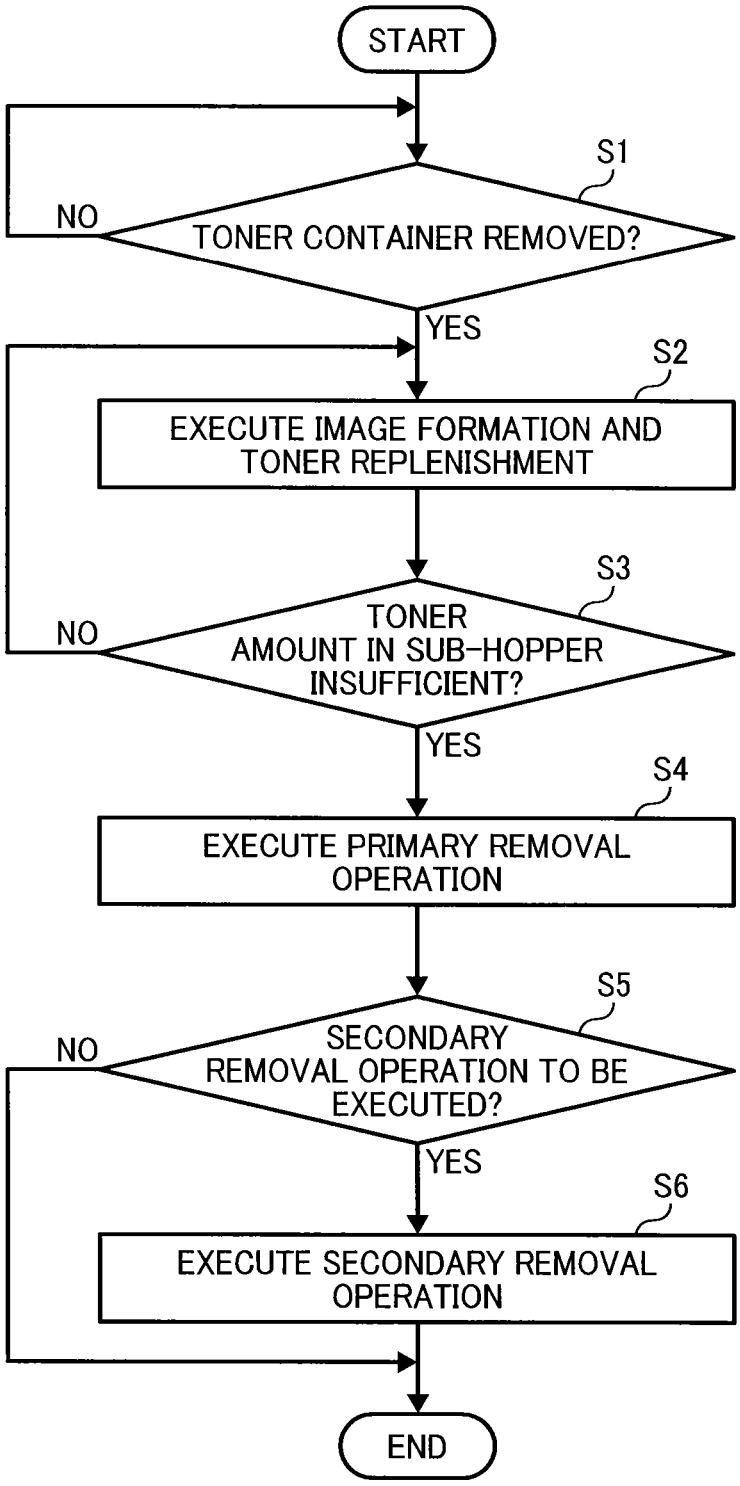
FIG. 7 is a flowchart illustrating a procedure of conveyance channel cleaning controlled by a controller, according to an embodiment.
Figure 8:
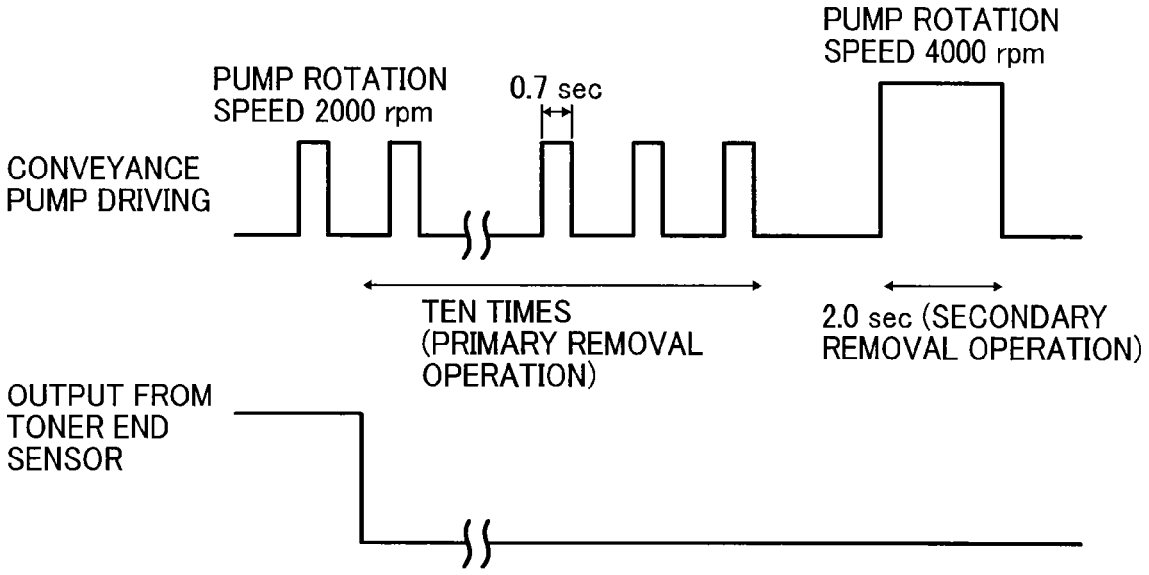
FIG. 8 is a timing chart of outputs from a toner end sensor of the sub-hopper and driving of the conveyance pump (i.e., a pump motor therefor) in the conveyance channel cleaning.

FIG. 7 is a flowchart illustrating a procedure of the conveyance channel cleaning controlled by the controller 34 according to the present embodiment. FIG. 8 is a timing chart of outputs from the toner end sensor 74 of the sub-hopper 54 and driving of the conveyance pump 53 (i.e., the pump motor 69 therefor) in the conveyance channel cleaning.

It is to be noted that, in the descriptions with reference to FIG. 7, the suffixes S, Y, M, C, and Bk attached to each reference numeral indicating special toner, yellow, magenta, cyan, and black, respectively, are omitted and the container mount 12B is simply referred to as container mount 12. The conveyance channel cleaning is started when it is instructed on the control panel 35 (shown in FIG. 3) connected to the controller 34.

At S1, whether the toner container 13 is removed from the container mount 12 is determined. The process proceeds to step S2 when it is deemed that the toner container 13 is removed (Yes at S1) and returns to step S1 when it is deemed that the toner container 13 is not removed (No at S1). Specifically, at S1, whether the toner container 13 is removed is judged according to signals input from the installation completion detector, which in the present embodiment includes the antenna board 12*b* and the electronic board 13*d*.

At S2, while the image forming unit 15 executes image formation, the toner replenishing device 50 executes the toner replenishment after it is judged that the toner container 13 is removed (at S1) or the amount of toner in the sub-hopper 54 is insufficient (at S3). At S2, special toner remaining in the toner replenishing device 50 is consumed in the state in which the toner container 13 is removed therefrom. Specifically, the image forming unit 15 executes image formation (charging, exposure, developing, transfer, and cleaning processes) using special toner to form a solid image, in which toner is transferred onto the sheet P entirely. In the cleaning process, the cleaning unit 24 mechanically collects toner remaining on the photoreceptor drum 21. Toner collected is transported to the waste toner bottle 27, and the periphery can be kept clean in the disposal. Additionally, in parallel to the image formation, the toner replenishing device 50 supplies toner to the image forming unit 15 to consume special toner present in the portion extending from the nozzle 51*p* (replenishing device connecting section) to the developing device 23 through the toner conveying tube 52, the conveyance pump 53, the sub-hopper 54, and the toner conveying pipe 55 in the image formation. Since special toner present in the portion from the nozzle 51*p* to the toner conveying tube 52 is transported by the conveyance pump 53 to the sub-hopper 54, it is possible that special toner overflows in the sub-hopper 54. Therefore, image formation in the image forming unit 15 is performed simultaneously at S2, thereby inhibiting special toner from overflowing in the sub-hopper 54. It is to be noted that the driving mechanism 12*a* (shown in FIG. 9) is not driven at S2 since the toner container 13 is removed from the container mount 12.

At S3, whether the amount of toner in the sub-hopper 54 (developer chamber 71) is insufficient is judged. The process proceeds to step S4 when it is deemed that the amount of toner is insufficient (Yes at S3) and returns to step S2 when it is deemed that the amount of toner is sufficient (No at S3). Whether the amount of toner in the developer chamber 71 of the sub-hopper 54 is insufficient is judged based on the toner detection signal from the toner end sensor 74. Specifically, a sufficient amount of toner is present when the toner end sensor 74 transmits the toner detection signal. By contrast, the amount of toner in the developer chamber 71 of the sub-hopper 54 is insufficient when the toner detection signal is not transmitted. If the insufficiency of toner in the sub-hopper 54 is not resolved in spite of driving of the conveyance pump 53, it means that the amount of toner supplied from the conveyance pump 53 is extremely small. That is, almost no toner is present in the portion from the nozzle 51*p* (replenishing device connecting section) through the toner conveying tube 52 to the conveyance pump 53. Accordingly, at S3, it is judged whether the amount of toner supplied from the conveyance pump 53 becomes extremely small, that is, the amount of toner in the portion from the nozzle 51*p* to the conveyance pump 53 via the nozzle 51*p* becomes extremely small.

At S4, a primary removal operation is executed, after which the process proceeds to step S5. As the primary removal operation, the conveyance pump 53 is intermittently driven repeatedly a predetermined number of times performs primary driving. That is, the conveyance pump 53 is driven for the predetermined duration, stopped, kept deactivated for the predetermined interval time, and then driven for the predetermined duration. Then, the conveyance pump 53 is stopped. In the present embodiment, for example, the predetermined consecutive driving duration of the conveyance pump 53 is 0.7 second, and the predetermined number of times the intermittent driving is repeated is ten times as shown in FIG. 8 (the conveyance pump 53 is driven 0.7 second repeatedly ten times). At S4, the primary removal operation is executed to remove toner from the portion extending from the nozzle 51*p* (replenishing device connecting section) to the conveyance pump 53 through the toner conveying tube 52, in particular, toner remaining in the toner conveying tube 52 from the following reason.

As described above, although it is deemed that the amount of toner supplied from the conveyance pump 53 becomes small at S3, it is not sure that toner supplied from the conveyance pump 53 is fully consumed. In other words, it is possible that toner still remains in the toner conveying tube 52 and the like although the amount thereof is small. Therefore, the primary removal operation is executed aiming at removing toner remaining in the toner conveying tube 52 and the like. It is to be noted that, in the primary removal operation at S4, the conveyance pump 53 is driven intermittently for the predetermined number of times and stopped to prevent excessive pressure rises in the sub-hopper 54 and the developing device 23. If pressure increases in the sub-hopper 54 and the developing device 23, there is a risk that toner scatters from the connections between the toner conveying pipe 55 and the sub-hopper 54 and the developing device 23, and the periphery of the developing roller 41 of the developing device 23.

Subsequent to the primary removal operation, at S5, it is judged whether a secondary removal operation (i.e., thorough removal of toner) is executed. To execute the secondary removal operation (Yes at S5), the process proceeds to step S6. The process ends when the secondary removal operation is not executed (No at S5).

Specifically, whether the secondary removal operation is executed is determined based on congenialities between first toner type used before replacement and the second toner type used after replacement. For example, when the first toner type is white toner and the second toner type is transparent toner (i.e., clear toner), white dots appear in the output image entirely if remaining white toner is mixed in transparent toner. By contrast, when the first toner type is transparent toner and the second toner type is white toner, mixing of transparent toner in white toner is not noticeable even if remaining transparent toner is mixed in white toner. Accordingly, on the premise that the toner type is different, the combination of toner types (such as the former case) that causes a defect due to mixing thereof is deemed "not congenial", whereas the combination of toner types (such as the latter case) that does not causes a defect due to mixing thereof is deemed "congenial".

Such congenialities are predetermined and stored as data in the electronic board 13*d*, the controller 34 (memory device 34*a*), or both. In the present embodiment, toner types congenial to the first toner type before replacement are preset, and the data is stored in the electronic board 13*d* and the memory device 34*a* of the controller 34. Then, at S5, when the second toner type is preset in correlation with the first toner or stored as a congenial type of the first toner type, it is determined that the secondary removal operation is not executed (No at S5). By contrast, when the second toner type is not preset in correlation with the first toner or not stored as a congenial type to the first toner type, it is determined that the secondary removal operation is executed (Yes at S5). The congeniality is determined on the premise that toner types are different. When the toner type is identical before and after the replacement of the toner container 13, it is deemed that the toner type is a congenial type (i.e., preset toner type), and the secondary removal operation is not executed (No at S5).

It is to be noted that the first toner type before replacement can be determined according to the data that the controller 34 acquires from the electronic board 13*d* provided to the toner container 13 (see FIG. 3). Additionally, the second toner type after replacement can be determined by the designation of toner type made when the conveyance channel cleaning is instructed on the control panel 35 (shown in FIG. 3) connected to the controller 34. It is to be noted that the above-described data can be acquired otherwise, for example, via a network.

At S6, the secondary removal operation is executed, and the conveyance channel cleaning is completed. Specifically, in the secondary removal operation, the conveyance pump 53, which transports toner through the toner conveying tube 52 from the toner container 13 to the developing device 23, is driven to exert a higher conveyance capability than that in the primary removal operation at S4. The conveyance capability is increased aiming at removing toner remaining in the toner conveying tube 52 and the like that is not removed by the primary removal operation. In the present embodiment, the conveyance capability can be increased by driving the conveyance pump 53 in the following two manners. A first manner is to drive the conveyance pump 53 consecutively for a period longer than that in the primary removal operation. A second manner is to drive the conveyance pump 53 by a force stronger than the driving force in the primary removal operation.

As one example of the first manner, the conveyance pump 53 may be consecutively driven, for example, 2 seconds so that the duration of driving can be, for example, 1 second to 3 seconds, longer than the predetermined consecutive driving duration (for example, 0.7 second) in the primary removal operation. It is assumed that, in the primary removal operation (similar in the toner replenishment), the pump motor 69 is driven at 2000 rpm with a voltage of 20 V.

By contrast, as one example of the second manner, to increase the driving force from that in the primary removal operation, the pump motor 69 is driven at 4000 rpm with a voltage of 24 V, for example. In the secondary removal operation according to the present embodiment, the conveyance pump 53 (i.e., the pump motor 69) is driven for 2 seconds consecutively at 4000 rpm with a voltage of 24 V (see FIG. 8). Therefore, in the secondary removal operation, a greater amount of airflow can be generated by the conveyance pump 53 in the portion extending from the nozzle 51*p* (replenishing device connecting section) to the conveyance pump 53 via the toner conveying tube 52 than the amount of airflow in the primary removal operation. Thus, the conveyance capability can be increased from that in the primary removal operation.

It is to be noted that the above-described driving of the conveyance pump 53 as the primary removal operation serves as "primary driving" and that in the secondary removal operation serves as "secondary driving".

Figure 10:
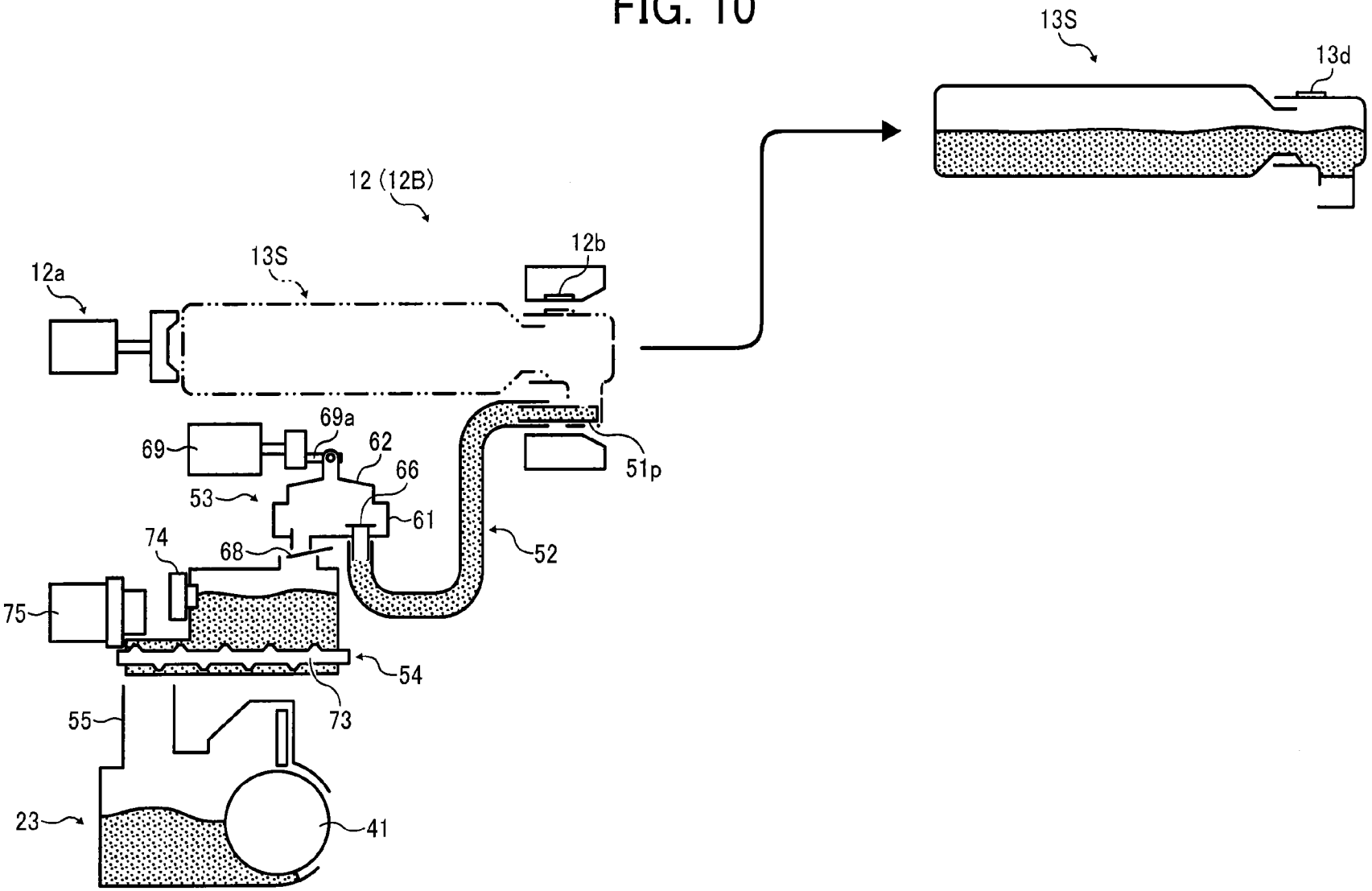
FIG. 10 illustrates a state in which the toner container is removed from the container mount shown in FIGS. 5A and 5B.
Figure 11:
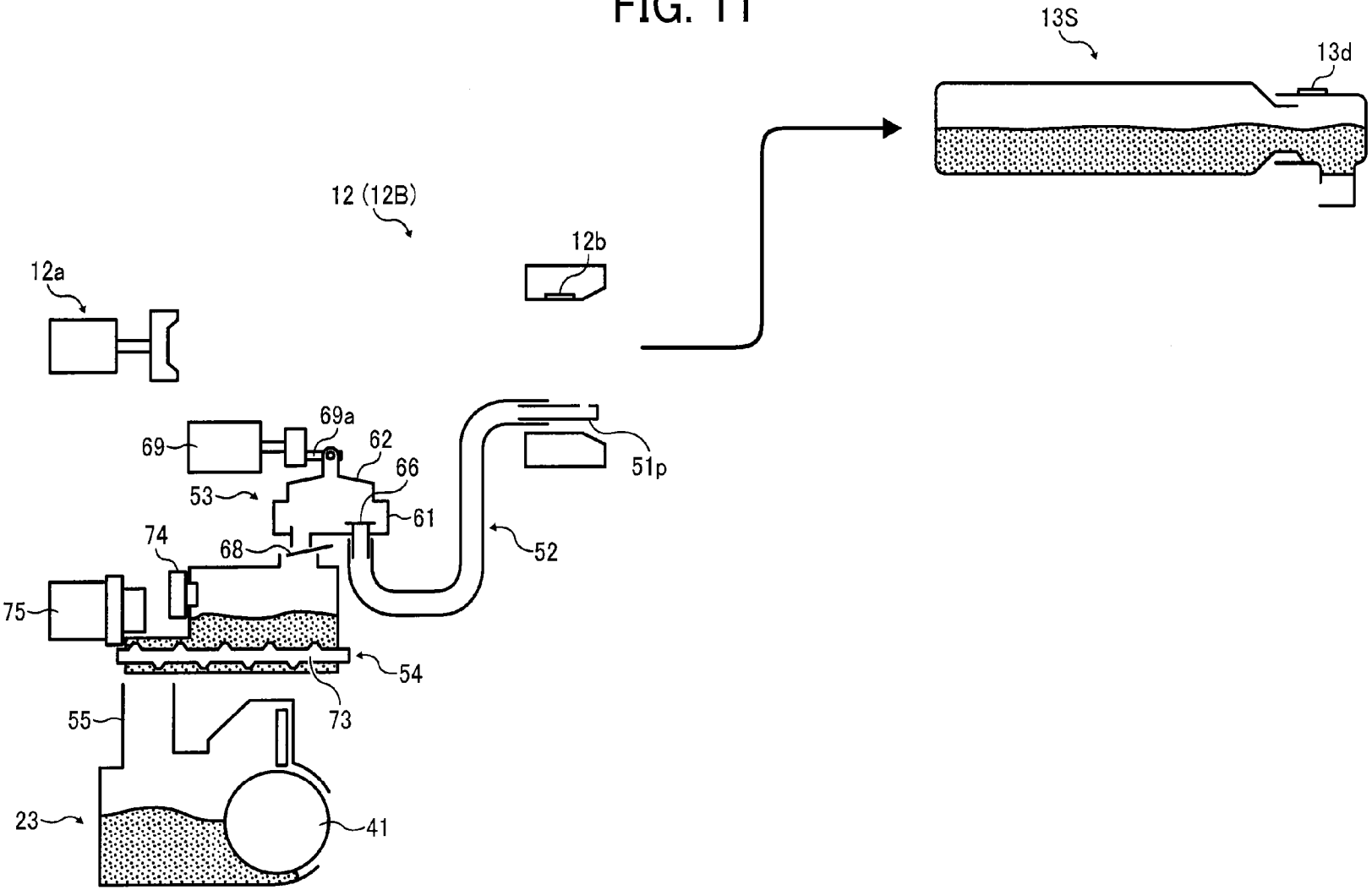
FIG. 11 is a schematic view illustrating a state in which the toner container is removed from the container mount shown in FIG. 10 and the conveyance channel cleaning is executed.

It is assumed that users form images using special toner suitable for the purpose of the image formation in the image forming apparatus 10 incorporating the toner replenishing device 50 (see FIG. 9). Subsequently, the user instructs execution of the conveyance channel cleaning on the control panel 35 (shown in FIG. 3) to change the toner type (special toner) and removes the toner container 13 from the container mount 12 as shown in FIG. 10. Then, steps S1 and S2 shown in FIG. 7 are performed in the image forming apparatus 10, and special toner remaining in the toner replenishing device 50 is consumed. When the amount of special toner in the sub-hopper 54, the developer chamber 71 thereof in particular, becomes insufficient (S3), the primary removal operation (such as the operation shown in FIG. 8) is executed (at S4). Then, whether the secondary removal operation (i.e., thorough removal of toner) is executed is judged (at S5). After the execution is determined, the secondary removal operation is executed (at S6), and the conveyance channel cleaning is completed. With this operation, the image forming apparatus 10 incorporating the toner replenishing device 50 can prevent the inconvenience that toner remains in the portion extending from the nozzle 51*p* to the conveyance pump 53 via the toner conveying tube 52 as shown in FIG. 11 (in practice, almost no toner remains in that portion).

Referring to FIG. 12, after the conveyance channel cleaning is thus completed, the user removes the conveyance pump 53 and the sub-hopper 54 integrated together and further removes the developing device 23 in the image forming unit 15. At that time, in the conveyance pump 53, it is necessary to disconnect the toner conveying tube 52 from the first end of the sucking-in channel 64. Since toner does not remain in the toner conveying tube 52, toner does not scatter therefrom, and the removal work can be easy. Additionally, referring to FIGS. 3 and 6, it is necessary to disconnect the toner conveying pipe 55 from the opening 72*a* positioned beneath the developer chamber 72 in the sub-hopper 54. Since the shutter piece 72*b* is provided to the opening 72*a*, toner does not scatter from the sub-hopper 54 (developer chamber 72), and the removal work can be easy. The developing device 23 can be removed similarly to conventional configurations. It is to be noted that the developing device 23 may be removed together with the photoreceptor drum 21 or in another manner as long as the removal with the developing roller 41 can be possible.

Subsequently, referring to FIG. 13, the user installs a developing device 23', a conveyance pump 53', and a sub-hopper 54' corresponding to the second toner and further installs a new toner container 13' containing the second toner in the container mount 12. With this operation, in the image forming apparatus 10 incorporating the toner replenishing device 50, the type of special toner can be changed, and the first toner before replacement can be prevented from being mixed in the second toner after replacement. It is to be noted that the type of special toner can be returned to the first toner type by performing the processes described above using the toner container 13, the conveyance pump 53, and the sub-hopper 54, and the developing device 23 removed in the processes described above.

Figure 13:
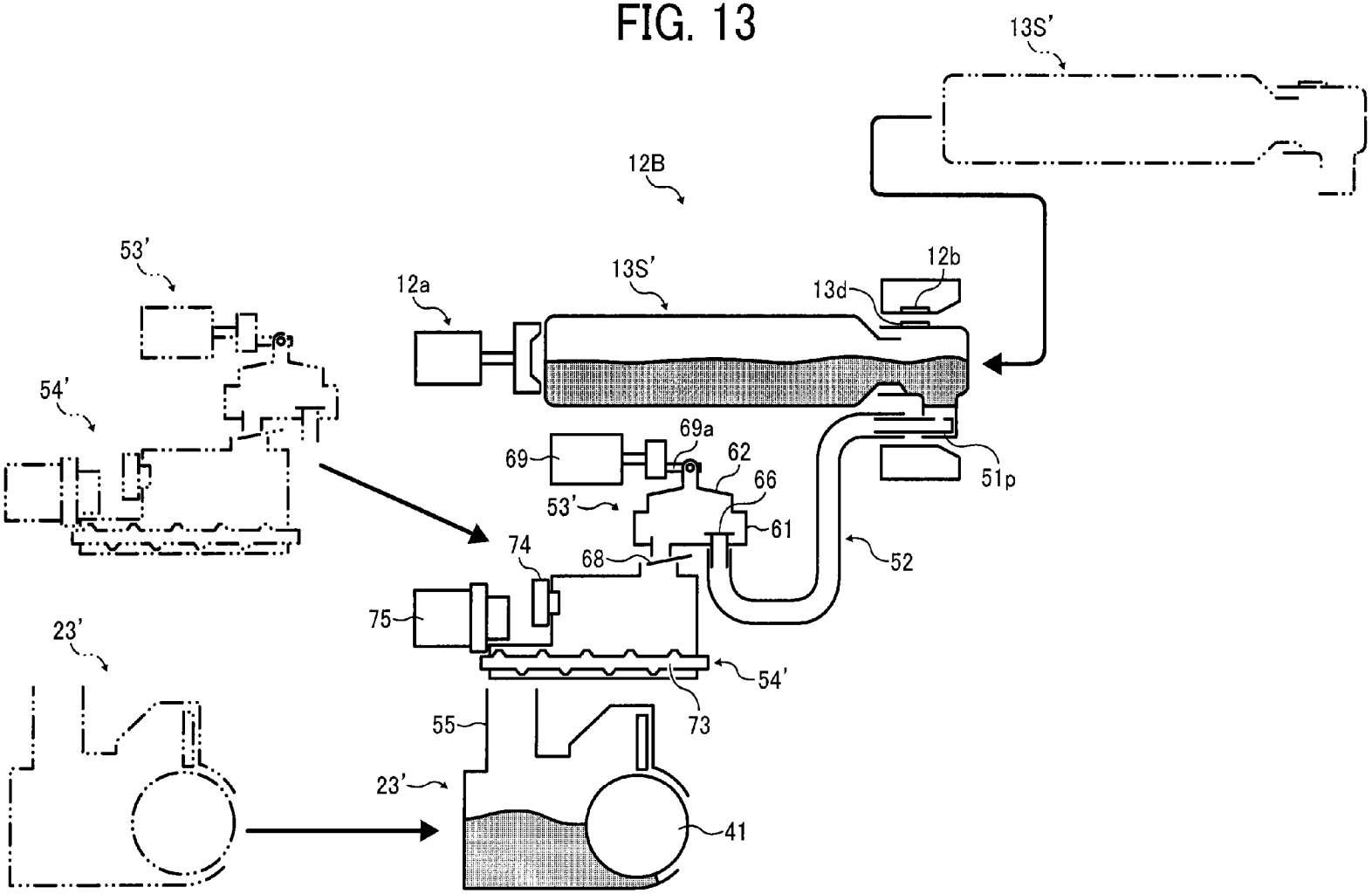
FIG. 13 is a schematic diagram illustrating installation of the toner container and installation of the conveyance pump, the sub-hopper, and the developing device corresponding thereto.

Herein, in the image forming apparatus 10 incorporating the toner replenishing device 50, the second toner is not present in the portion from the nozzle 51*p* to the sub-hopper 54' via the toner conveying tube 52 and the conveyance pump 53' (see FIG. 13). Accordingly, there is a risk that the concentration of toner in developer in the developer containing compartment 44 of the developing device 23' decreases below the predetermined value when images are formed on the sheet P using the second toner. Therefore, in the present embodiment, when the developing device 23', the conveyance pump 53', and the sub-hopper 54' are installed in the image forming apparatus 10 and further the new toner container 13S' is held in the container mount 12, an initial filling operation described below is performed.

In the initial filling operation in the toner replenishing device 50 is controlled by the controller 34. The initial filling operation is initiated by completion of the conveyance channel cleaning.

Figure 14:
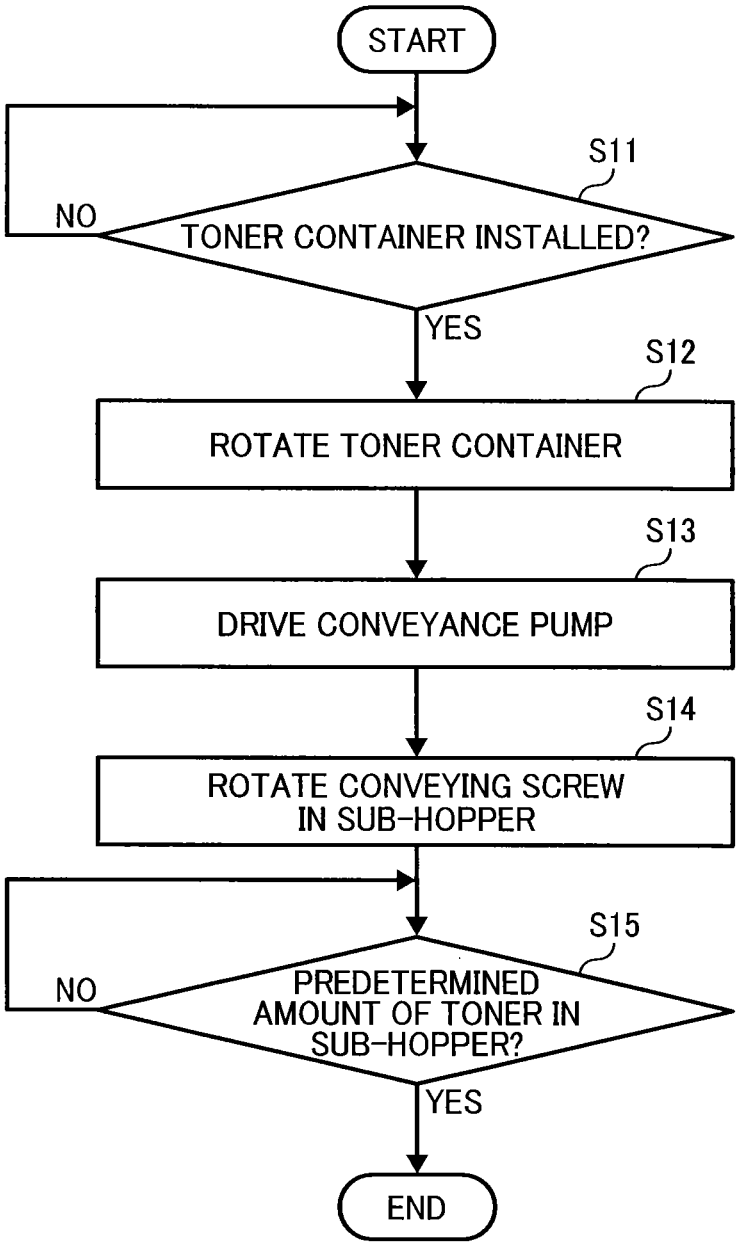
FIG. 14 is a flowchart illustrating a procedure of initial filling operation controlled by the controller, according to an embodiment.

FIG. 14 is a flowchart illustrating a procedure of the initial filling operation controlled by the controller 34 according to the present embodiment.

It is to be noted that, in the descriptions below, apostrophe (') attached to the end of reference numeral of the new toner container 13'(13S') and the developing device 23', the conveyance pump 53', and the sub-hopper 54', corresponding to the second toner is omitted for simplicity. However, the apostrophe (') is attached to the reference numerals in FIG. 15 for ease of understanding similarly to FIG. 14.

At S11, whether the toner container 13S is fully held in the container mount 12 is judged. The process proceeds to step S12 when it is deemed that the toner container 13S is installed (Yes at S11) and returns to step S11 when it is deemed that the toner container 13S is not installed (No at S11). Specifically, at S11, whether the toner container 13S is fully installed is judged according to signals input from the installation completion detector, which in the present embodiment includes the antenna board 12*b* and the electronic board 13*d*. It is to be noted that the step 11 is on the premise that the new developing device 23, the conveyance pump 53, and the new sub-hopper 54 are installed.

At S12, the toner container 13S is rotated. Specifically, the driving mechanism 12*a* is driven, thereby rotating the container body 13*p* (shown in FIGS. 5A and 5B) of the toner container 13S. With this operation, special toner contained in the container body 13*p* of the toner container 13S can be fed to the container-side connecting section 13*q* (shown in FIGS. 5A and 5B) and temporarily stored therein. Then, toner can be further transported via the connection opening 51*q* to the nozzle 51*p*.

At S13, the conveyance pump 53 is driven. Specifically, the pump motor 69 is driven, thereby driving the conveyance pump 53. With this operation, the special toner temporarily stored in the container-side connecting section 13*q* can be transported via the connection opening 51*q* and the nozzle 51*p* to the toner conveying tube 52 and further to the conveyance pump 53 (the operation chamber 63 thereof). Then, the special toner is discharged into the developer chamber 71 of the sub-hopper 54.

At S14, the conveying screws 73 in the sub-hopper 54 are rotated. Specifically, the screw driving mechanism 75 is driven to rotate the conveying screws 73. With this operation, in the sub-hopper 54, toner is agitated and circulated between the developer chambers 71 and 72. It is to be noted that, at S14, differently from other operations such as toner replenishment, toner circulated by the conveying screws 73 between the developer chambers 71 and 72 does not reach the opening 72*a* of the developer chamber 72. This is because the step S14 is executed to level off the supplied toner in the developer chambers 71 and 72 in the sub-hopper 54.

At S15, whether the amount of toner in the sub-hopper 54 (developer chamber 71) is the predetermined amount is judged. The process completes when it is deemed that the predetermined amount of toner is contained in the sub-hopper 54 (Yes at S15) and repeats step S15 when it is deemed that the amount of toner is sufficient (No at S15). Whether the amount of toner in the developer chamber 71 is at the predetermined amount is judged by detecting the presence of the toner detection signal from the toner end sensor 74. When the amount of toner in the developer chamber 71 reaches the predetermined amount, rotation of the conveying screws 73 by the screw driving mechanism 75, driving of the conveyance pump 53 by the pump motor 69, and rotation of the toner container 13S (container body 13*p*) by the driving mechanism 12*a* are stopped. Then, the initial filling operation is completed.

Figure 15:
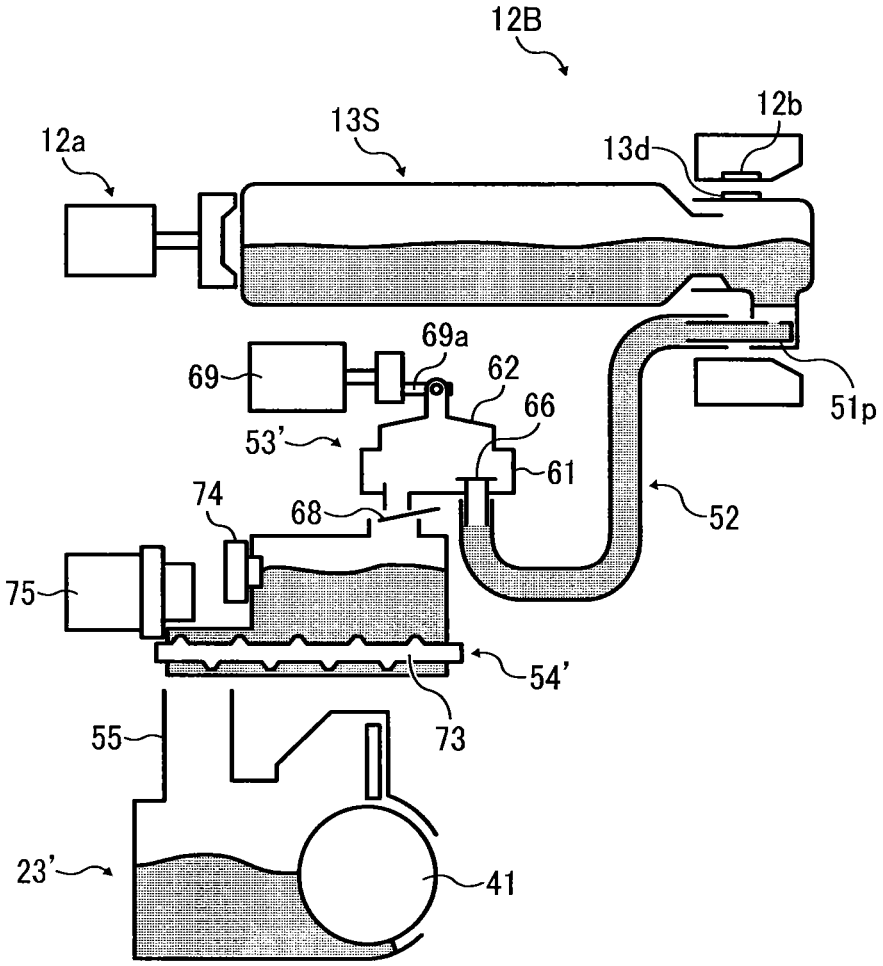
FIG. 15 illustrates a state in which second toner (another toner) is supplied to a portion extending from a nozzle (i.e., replenishing device connecting section) to the sub-hopper via a toner conveying tube and the conveyance pump in the initial filling operation.

By performing the initial filling operation, the second toner can be supplied to the portion between the nozzle 51*p* (replenishing device connecting section) and the sub-hopper 54 via the toner conveying tube 52 and the conveyance pump 53 (see FIG. 15). Then, by performing the toner replenishment described above, the concentration of toner in developer in the developer containing compartment 44 of the developing device 23 can be kept within the predetermined range even when images are formed on sheets using the second toner.

In the present embodiment, the toner replenishing device 50 executes the conveyance channel cleaning in which the conveyance pump 53 is driven in the state in which the toner container 13S is not installed in the corresponding container mount 12. Accordingly, in the state in which toner is not supplied form the toner container 13S, the toner replenishing device 50 can transport toner present in the portion between the nozzle 51*p* and the conveyance pump 53 via the toner conveying tube 52. Then, the conveyance pump 53 can suck out and remove toner from the portion between the nozzle 51*p* and the conveyance pump 53 via the toner conveying tube 52.

Additionally, the conveyance pump 53 is driven for the conveyance channel cleaning after the replaceable toner container 13S is removed from the container mount 12. This operation can increase the efficiency of driving of the conveyance pump 53 to remove toner from the portion extending from the nozzle 51*p* to the conveyance pump 53 via the toner conveying tube 52.

Additionally, whether the toner container 13S is removed is judged according to signals input from the installation completion detector, which in the present embodiment includes the antenna board 12*b* and the electronic board 13*d*. This configuration can secure the driving of the conveyance pump 53 in the state in which the toner container 13S is not in the container mount 12.

In the toner replenishing device 50, the conveyance pump 53 is used to transport toner through the toner conveying tube 52 serving as the conveyance channel. Accordingly, while maintaining the design (layout) flexibility of the portion extending from the nozzle 51*p* to the conveyance pump 53 via the toner conveying tube 52, toner can be sucked out and removed from that portion. This configuration is advantageous over a configuration that employs a developer conveyor, such as a conveying screw, capable of transporting only toner in contact with the developer conveyor because this imposes a limitation that toner should be transported under the weight of toner in areas where the developer conveyor does not contact toner.

In the toner replenishing device 50, a diaphragm pump is used as the conveyance pump 53. Accordingly, even in the state in which toner is not supplied form the toner container 13S, the toner replenishing device 50 can suck in toner remaining in the portion extending from the nozzle 51*p* to the conveyance pump 53 via the toner conveying tube 52, thereby removing toner more effectively. By contrast, for example, when a suction-type uniaxial eccentric screw pump is used, there is a risk that only air in clearance created in the toner conveying tube 52 is sucked as the amount of toner in the toner conveying tube 52 falls to a certain amount. By contrast, diaphragm pumps are mainly used to transport fluid, and it is easy to increase the volume of the operation chamber 63. Accordingly, even if clearance is created in the toner conveying tube 52 as the amount of toner decreases, toner can be sucked together with air present in the clearance. Thus, remaining toner can be sucked out more securely, thus removing toner more effectively. It is to be noted that the diaphragm-type conveyance pump 53 can suck in toner without any conveniences since powdered toner behaves like fluid.

Since the container mount 12B to hold the toner container 13S uses the nozzle 51*p* as the connecting section on the side of the replenishing device 50, in the state in which the toner container 13S is removed, the end portion of the toner conveying tube 52 can be the nozzle 51*p* that is substantially identical in inner diameter to the toner conveying tube 52. This configuration can inhibit expansion of the inner diameter of the portion extending from the nozzle 51*p* to the conveyance pump 53 via the toner conveying tube 52, where toner can remain. Therefore, in the toner replenishing device 50, the velocity of flow caused in the portion extending from the nozzle 51*p* to the toner conveying tube 52 by the suction of the conveyance pump 53 can be substantially identical even in the nozzle 51*p* (i.e., an upstream portion). Thus, remaining toner can be sucked out more reliably, thus removing toner more effectively.

In the toner replenishing device 50, the nozzle 51*p* is provided only to the container mount 12B corresponding to special toner as the replenishing device connecting section, and the toner container 13S for containing special toner is connectable to the nozzle 51*p*. Additionally, the toner reservoir 51*a* is provided to the container mount 12A corresponding to other toners as the replenishing device connecting section, and the toner containers 13 for containing other toners are connectable to the respective toner reservoirs 51*a*. The former is advantageous in enhancing the toner removal effects by driving the conveyance pump 53 as the conveyance channel cleaning. The cost of latter can be lower than that of the former and is advantageous from the viewpoint of the cost. In view of the foregoing, the former is used only in the toner replenishing device 50 corresponding to toners changed according to intended use, and the latter is used in the toner replenishing devices 50 corresponding to other toners. Thus, the convenience is enhanced while inhibiting increases in the cost.

In the toner replenishing device 50, the developing device 23 can be removed from the apparatus body (i.e., housing 11), and additionally the conveyance pump 53 and the sub-hopper 54 can be united together to be removed at a time. Then, toner remaining in the portion extending from the nozzle 51*p* (replenishing device connecting section) to the toner conveying tube 52 can be sucked out more reliably, thus removing toner more effectively. With this configuration, in the toner replenishing device 50, the first toner used before replacement can be removed, thereby preventing mixing of the first toner in the second toner after replacement. Accordingly, degradation of quality of images formed on the sheets P can be inhibited.

The toner replenishing device 50 can facilitate change of toner type since toner is removed from the portion from the nozzle 51*p* to the conveyance pump 53 via the toner conveying tube 52 by suction of the conveyance pump 53 due to the features below. Although switching the first toner to the second toner different from the first toner may be attained by replacing the toner container 13 and the developing device 23, toner tends to remain in the portion extending between the nozzle 51*p* (replenishing device connecting section) and the conveyance pump 53 via the toner conveying tube 52 and further to the sub-hopper 54.

This inconvenience may be solved by using a replaceable toner conveying tube, the replaceable conveyance pump 53, and the replaceable sub-hopper 54, in addition to the replaceable developing device 23. However, there is a difficulty that the toner conveying tube 52 passes between various components inside the image forming apparatus 10 to connect the container mount 12 (replenishing device connecting section thereof) to the developing device 23 (and the sub-hopper 54) of the corresponding toner type.

In particular, in the present embodiment, due to the relative positions of the developing device 23S and the container mount 12B (i.e., the toner container 13S therein), the toner conveying tube 52 for transporting special toner is long and disposed to pass through the clearances between the various components inside the image forming apparatus 10. Accordingly, it is not easy to make the toner conveying tube 52 replaceable because it is difficult to install a new toner conveying tube 52 without bending it or disposing in wrong portions even if simply removing the toner conveying tube 52 is easy. In particular, since toner remains inside the toner conveying tube 52 at the replacement thereof, it is necessary to provide a preventive for toner leak during the replacement. Although the toner conveying tube 52 may be divided into multiple pieces so that the toner conveying tube 52 can be disposed between various components, doing so makes the replacement work complicated. Further, the preventive for leak of toner should be provided to each of divided pieces, making it more complicated. Although toner remaining in the toner conveying tube 52 may be removed using an external device such as vacuum cleaner, it is difficult to prevent scattering of toner in this approach.

By contrast, in the present embodiment, toner remaining in the portion from the nozzle 51*p* through the toner conveying tube 52 can be removed by suction executed by the conveyance pump 53. Therefore, in the toner replenishing device 50, the developing device 23, the conveyance pump 53, and the sub-hopper 54 can be replaceable, whereas the toner conveying tube 52 is not replaced. Therefore, changing the toner type can be facilitated while inhibiting the first toner before replacement from being mixed in the second toner used after replacement.

In the toner replenishing device 50, the primary removal operation is executed when it is deemed that toner in the sub-hopper 54 becomes insufficient while the conveyance pump 53 operates during the conveyance channel cleaning. At that time, if the insufficiency of toner in the sub-hopper 54 is not resolved in spite of driving of the conveyance pump 53, it means that little toner remains in the portion from the nozzle 51*p* to the conveyance pump 53 via the toner conveying tube 52. Since the primary removal operation is thus executed when the amount of remaining toner is extremely small, the toner remaining in the portion from the nozzle 51*p* to the conveyance pump 53 via the toner conveying tube 52 can be removed with a higher degree of reliability.

In the primary removal operation according to the present embodiment, intermittent driving of the conveyance pump 53 is repeated the predetermined number of times. That is, the conveyance pump 53 is cyclically driven for the predetermined duration, stopped, kept deactivated for the predetermined interval time, and then driven for the predetermined duration. Accordingly, toner can be sucked out from the toner conveying tube 52 at a predetermined flow rate for a predetermined time from the state in which little toner remains in the portion extending from the nozzle 51*p* to the conveyance pump 53 via the toner conveying tube 52. In other words, in the toner replenishing device 50, the predetermined primary removal operation is executed regardless of the result of detection at each detection positions. Then, toner remaining in the portion from the nozzle 51*p* to the conveyance pump 53 via the toner conveying tube 52, if any, can be removed.

In the primary removal operation according to the present embodiment, the conveyance pump 53 is stopped after intermittent driving of the conveyance pump 53 is repeated the predetermined number of times. Accordingly, an excessive pressure rises in the sub-hopper 54 and the developing device 23 can be inhibited, and scattering of toner therefrom can be inhibited. Although an excessive pressure rise may be prevented by forming an air vent in the sub-hopper 54 and providing a filter to the air vent to prevent passage of toner, the pressure releasing effect attained by this configuration is limited. Thus, the above-described intermittent driving cycle is advantageous.

In the conveyance channel cleaning according to the present embodiment, since the secondary removal operation is executed after the primary removal operation, toner remaining in the portion from the nozzle 51*p* to the conveyance pump 53 via the toner conveying tube 52 can be removed more reliably.

In the toner replenishing device 50, whether or not to execute the secondary removal operation in the conveyance channel cleaning is determined based on congenialities between first toner type used before replacement and the second toner type used after replacement. Therefore, in the toner replenishing device 50, the secondary removal operation is not executed in cases where the risk of image quality degradation is small, and the secondary removal operation is executed when it is required (there is the possibility of image quality degradation). Therefore, the time required for the conveyance channel cleaning can be reduced while inhibiting image quality degradation.

In the present embodiment, second toner types congenial to the first toner type (i.e., original toner) are set preliminarily, and the data is stored in the electronic board 13*d* and the memory device 34*a* of the controller 34. Additionally, when the second toner type after replacement is stored in relation to the first toner type, it is determined that the second toner type is preset and a congenial type. By contrast, when the second toner type after replacement is not stored in relation to the first toner type, it is determined that the second toner type is not preset and uncongenial. This configuration can simplify the determination of congeniality, that is, whether the secondary removal operation is to be executed, and this determination can be made properly.

By performing the initial filling operation after the conveyance channel cleaning is completed, the second toner can be supplied to the portion extending from the nozzle 51*p* (replenishing device connecting section) to the sub-hopper 54 through the toner conveying tube 52 and the conveyance pump 53 (see FIG. 15). Accordingly, the concentration of toner in developer in the developer containing compartment 44 of the developing device 23 can be kept within the predetermined range even when images are formed using the second toner.

In the toner replenishing device 50, the configuration to supply toner from the toner container 13 to the developing device 23 is used to remove toner remaining in the portion from the nozzle 51*p* to the conveyance pump 53 via the toner conveying tube 52, if any. Therefore, changing the toner type can be facilitated while making the configuration of the toner replenishing device 50 simpler. Specifically, the toner replenishing device 50 is capable of supplying toner from the toner container 13 to the developing device 23 and removing toner remaining in the portion between the nozzle 51*p* and the conveyance pump 53 via the toner conveying tube 52, if any.

In the image forming apparatus 10 incorporating the toner replenishing device 50, toner type can be changed easily, thus enhancing the usability, while inhibiting image quality degradation.

Thus, different toner types (i.e., different developer types) can be used without degrading image quality.

It is to be noted that the present invention is not limited to the specific configurations described above but can be embodied otherwise as long as the developer replenishing device satisfies the requirements:

A) the developer replenishing device includes a container mount to which a developer container is mountable, an installation completion detector to detect whether the developer container is mounted to the container mount, a containing portion to store developer, a conveyance channel connecting the developer container to the containing portion, a conveyance pump to transport developer from the developer container through the conveyance channel to the containing portion;

B) the containing portion is replaceable and removably connected to the conveyance channel; and C) in a state in which the developer container is not held in the container mount according to a detection result generated by the installation completion detector, the conveyance pump transports developer from the conveyance channel to the containing portion.

Additionally, although the image forming unit 15 executes image formation at S2 shown in FIG. 7 in the above-described embodiment, any other operation to consume toner (special toner) may be executed at S2. For example, the different operation can be cleaning process in which the developing device 23 in the image forming unit 15 supplies toner to the photoreceptor drum 21, and the cleaning unit 24 mechanically collects the toner from the photoreceptor drum 21. Alternatively, the developing device 23 in the image forming unit 15 supplies toner to the photoreceptor drum 21, the toner is transferred from the photoreceptor drum 21 onto the intermediate transfer belt 14*a*, and then the intermediate-transfer cleaning unit 14*c* collects the toner from the intermediate transfer belt 14*a*.

Yet alternatively, special toner supplied to the photoreceptor drum 21S by the developing device 23S in the image forming unit 15S is transferred onto the intermediate transfer belt 14*a*, and then the special toner is reversely transferred from the intermediate transfer belt 14*a* onto the photoreceptor drum 21 of the different image forming unit 15 (15Y, 15M, 15C, or 15Bk). Reversing the transfer bias of the primary-transfer bias roller 14*b* enables such reverse transfer. Then, the cleaning unit 24 mechanically collects toner from the photoreceptor drum 21 of the different image forming unit 15 (15Y, 15M, 15C, or 15Bk). The last example can be possible in the arrangement in which the image forming unit 15S using special toner is disposed upstream from any of other image forming units 15Y, 15M, 15C, and 15Bk in the direction in which the intermediate transfer belt 14*a* rotates as in the above-described embodiment. Since the toner collected by the cleaning unit 24 and the intermediate-transfer cleaning unit 14*c* is transported to the waste toner bottle 27, the periphery is not contaminated in disposal of the collected toner. Therefore, at S2, one of the three examples may be executed instead of executing image formation. Yet alternatively, the three examples and image formation may be combined fitly.

Further, instead of executing image formation, at step S2, toner (special toner) remaining in the toner replenishing device 50 may be consumed as follows. When the conveyance channel cleaning is executed, the developing device 23 is removed, and a waste toner bottle similar to the waste toner bottle 27 is connected to the opening 72*a* beneath the developer chamber 72 of the sub-hopper 54. This configuration can further simplifies the operation (control processing) in the image forming apparatus 10 in the conveyance channel cleaning.

Although the conveyance channel cleaning is executed only in the toner replenishing device 50 corresponding to the toner container 13S in the description above, alternatively, the conveyance channel cleaning may be executed in other toner replenishing devices 50. It is to be noted that, in this case, it is preferred that the container mount 12A includes the nozzle 51*p* instead of the toner reservoir 51*a* as the replenishing device connecting section to reliably remove toner remaining in the portion extending from the replenishing device connecting section to the conveyance pump 53, in particular, toner remaining in the toner conveying tube 52. Since the toner reservoir 51*a* has an inner diameter greater than that of the toner conveying tube 52 and that of the cylindrical connecting compartment 51*e*, removal of toner inside the toner reservoir 51*a* serving as the replenishing device connecting section is difficult.

Although the diaphragm conveyance pump 53 is used in the above-described embodiment, uniaxial eccentric screw pumps or pumps of other types may be used as long as toner can be transported by generating pressure differences, without direct contact with toner, from the toner container 13 to the developing device 23 (image forming unit 15) via the toner conveying tube 52 serving as the conveyance channel.

Additionally, the toner replenishing device 50 can adapt to single-color image forming apparatuses instead of multicolor image forming apparatuses.

Additionally, although two-component developer consisting essentially of carrier (carrier particles) and toner (toner particles) is used in the above-described embodiments, the features of the present invention can adapt to one-component developer. For example, developer replenishing devices as the embodiments of the present invention can supply toner, carrier to electrostatically adsorb toner, or mixture (i.e., premixed toner) of toner and carrier. In each case, similar effects can be attained.

Additionally, although the description above concerns an image forming apparatus employing an intermediate transfer method, the above-described aspects of the present invention can adapt to configurations in which the developing device 23 forms images using toner contained in the toner container 13 regardless of image transfer type.

Although the description above concerns the toner replenishing device 50 to transport developer from the toner container 13 to the developing device 23, alternatively, the above-described aspects of the present invention can adapt to configurations to transport powder or fluid contained in a container to a replenishment target via a conveyance channel using a conveyance pump. In this case, similar effects can be attained.

Numerous additional modifications and variations are possible in light of the above teachings. It is therefore to be understood that, within the scope of the appended claims, the disclosure of this patent specification may be practiced otherwise than as specifically described herein. The number, position, and shape of the components of the image forming apparatus described above are not limited to those described above.

What is claimed is:

1. A developer replenishing device comprising:

a container mount to hold a developer container to contain developer used in image formation;

an installation completion detector to detect completion of installation of the developer container in the container mount;

a containing portion to contain developer supplied from the developer container;

a conveyance channel through which developer is transported from the developer container held in the container mount to the containing portion; and a conveyance pump to transport developer from the developer container through the conveyance channel to the containing portion, wherein the containing portion is replaceable and removably connected to the conveyance channel, and in a state in which the developer container is not held in the container mount according to a detection result by the installation completion detector, the conveyance pump transports developer from the conveyance channel to the containing portion.

2. The developer replenishing device according to claim 1, wherein the conveyance pump comprises a case and a diaphragm attached to the case.

3. The developer replenishing device according to claim 2, further comprising a nozzle having an inner diameter smaller than an inner diameter of the conveyance channel, the nozzle connected between the conveyance channel and the developer container held in the container mount.

4. The developer replenishing device according to claim 1, wherein the containing portion comprises a developer amount detector, and while the conveyance pump operates in a state in which the developer container is not held in the container mount according to the detection result by the installation completion detector, when the developer amount detector detects that the amount of developer in the containing portion falls below a predetermined amount, the conveyance pump is stopped after operating for a predetermined period as primary driving from a point of time of detection made by the developer amount detector.

5. The developer replenishing device according to claim 4, wherein, after stopping the primary driving, the conveyance pump performs secondary driving in which a conveyance capability is increased from a conveyance capability in the primary driving.

6. The developer replenishing device according to claim 5, wherein, in the secondary driving, the conveyance pump is consecutively driven longer than a consecutive driving duration in the primary driving to increase the conveyance capability.

7. The developer replenishing device according to claim 5, wherein, in the secondary driving, the conveyance pump is driven with a driving force greater than a driving force in the primary driving to increase the conveyance capability.

8. The developer replenishing device according to claim 5, wherein, in a case where the developer container containing a first toner is replaced with another developer container containing a second toner different from the first toner, the conveyance pump does not perform the secondary driving when the second toner is preset in correlation with the first toner, and the conveyance pump performs the secondary driving in which the conveyance capability is increased when the second toner is not preset in correlation with the first toner.

9. The developer replenishing device according to claim 4, wherein a discharge driving unit is provided to the container mount to discharge developer from the developer container held in the container mount, and when the developer container is held in the container mount after the conveyance pump performs the primary driving and is stopped, the discharge driving unit drives the developer container to discharge developer therefrom, and the conveyance pump transports developer discharged from the developer container to the containing portion via the conveyance channel.

10. The developer replenishing device according to claim 1 wherein the developer container comprises a temporary containing portion to temporarily store developer supplied to a developing device, and developer is transported through the conveyance channel from the developer container held in the container mount to the temporary containing portion.

11. The developer replenishing device according to claim 10, wherein the conveyance pump is disposed at one end of the conveyance channel on a side of the temporary containing portion and removably connected to the conveyance channel, and the conveyance pump and the temporary containing portion are united to be replaced together at a time.

12. An image forming apparatus comprising:

an image bearer on which an image is formed with developer; and the developer replenishing device according to claim 1.

13. A developer replenishing device comprising:

a container mount to hold a developer container to contain developer used in image formation;

a containing portion to contain developer supplied from the developer container;

a conveyance channel through which developer is transported from the developer container held in the container mount to the containing portion; and a conveyance member to transport developer from the developer container through the conveyance channel to the containing portion, wherein the containing portion is replaceable and removably connected to the conveyance channel, and in a state in which the developer container is not held in the container mount the conveyance member transports developer from the conveyance channel to the containing portion.

14. The developer replenishing device according to claim 13, further comprising:

an installation completion detector to detect completion of installation of the developer container in the container mount, wherein the developer replenishing device is to judge whether the developer container is in the container mount according to a detection result generated by the installation completion detector.

15. The developer replenishing device according to claim 13, wherein the conveyance member is a pump.

* * * * *